US010830534B2

(12) United States Patent
Martin et al.

(10) Patent No.: US 10,830,534 B2
(45) Date of Patent: Nov. 10, 2020

(54) SYSTEM AND APPARATUS FOR DRYING HAY BALES

(71) Applicant: Chinook Hay Systems Inc., Alma (CA)

(72) Inventors: Christopher S. Martin, Alma (CA); Jared S. Martin, St. Jacobs (CA); Edgar S. Reist, Elmira (CA); Clarence S. Reist, Elmira (CA)

(73) Assignee: Chinook Hay Systems, Inc., Alma (CA)

( * ) Notice: Subject to any disclaimer, the term of this patent is extended or adjusted under 35 U.S.C. 154(b) by 111 days.

(21) Appl. No.: 16/039,408

(22) Filed: Jul. 19, 2018

(65) Prior Publication Data

US 2019/0024973 A1 Jan. 24, 2019

Related U.S. Application Data

(60) Provisional application No. 62/534,903, filed on Jul. 20, 2017.

(51) Int. Cl.

| | |
|---|---|
| ***F26B 9/10*** | (2006.01) |
| ***F26B 21/00*** | (2006.01) |
| ***F26B 9/00*** | (2006.01) |

(52) U.S. Cl.

CPC ..... *F26B 9/106* (2013.01); *F26B 9/006* (2013.01); *F26B 21/001* (2013.01); *F26B 21/004* (2013.01); *F26B 2200/02* (2013.01); *F26B 2200/10* (2013.01)

(58) Field of Classification Search

CPC ..... F26B 9/106; F26B 21/001; F26B 9/006; F26B 21/004; F26B 2200/02; F26B 2200/10

See application file for complete search history.

(56) References Cited

U.S. PATENT DOCUMENTS

| | | | |
|---|---|---|---|
| 1,332,629 | A | 3/1920 | McIntyre |
| 1,946,814 | A | 2/1934 | Sims |
| 4,185,549 | A | 1/1980 | Roepnack |
| 4,450,178 | A | 5/1984 | Korsgaard |
| 4,459,798 | A | 7/1984 | Penfold et al. |
| 5,789,072 | A | 8/1998 | Ulrich |

(Continued)

FOREIGN PATENT DOCUMENTS

| | | | |
|---|---|---|---|
| CA | 2965009 | A1 | 10/2018 |
| WO | 2012001461 | A1 | 1/2012 |

OTHER PUBLICATIONS

Examiner's Report for Canadian Application 2,987,525, dated Jul. 27, 2018.

(Continued)

*Primary Examiner* — Jessica Yuen

(74) *Attorney, Agent, or Firm* — Westman, Champlin & Koehler, P.A.

(57) ABSTRACT

A bale dryer including a support frame, at least one air intake manifold movably coupled to the support frame for supplying heated air, a bale retainer coupled to the support frame and configured for retaining at least one bale in a fixed position vertically spaced from the at least one air intake manifold, and an actuator coupled to the at least one air intake manifold and configured to move the at least one air intake manifold between a retracted positon and an extended positon.

15 Claims, 18 Drawing Sheets

(56) References Cited

U.S. PATENT DOCUMENTS

| | | | | |
|---|---|---|---|---|
| 6,079,119 | A | 6/2000 | Magnusson | |
| 2018/0306502 | A1 | 10/2018 | Gulbranson et al. | |
| 2018/0306503 | A1* | 10/2018 | Gulbranson ..... | F26B 21/001 |

OTHER PUBLICATIONS

Examiner's Report for Canadian Application 2,987,525, dated Oct. 31, 2018.

* cited by examiner

SYSTEM AND APPARATUS FOR DRYING HAY BALES

CROSS REFERENCE TO RELATED APPLICATIONS

This application claims the benefit of U.S. Patent Application No. 62/534,903, filed Jul. 20, 2017, the contents of which are incorporated herein by reference.

TECHNICAL FIELD

The embodiments disclosed herein relate to drying hay bales and, in particular to a system and apparatus for drying hay bales.

BACKGROUND

In various places around the world hay is cut and stored for later uses, such as use for animal feed or bedding. It is often convenient for this hay to be baled prior to storage or transportation.

In various places around the world a market exists for bales of hay. The price of a bale of hay having a moisture content between 5 percent and 20 percent tends to be considerably higher than the price of a bale having significantly higher or lower moisture content.

When hay is cut from a field, the moisture content may be significantly higher than 20 percent. For example, the moisture content may be 25 percent or 30 percent or more. Often hay will be left in the field to dry. However, in various circumstances, hay left in the field does not dry to an optimal level. For example, rain or dew may fall upon the hay before it is gathered and baled.

In addition, drying hay by leaving it in the field for a time may result in the sun bleaching the hay, or may result in the hay being otherwise reduced in quality as protein-rich leaves may dry and crumble and fall to the ground where they will not be captured by a baling machine.

Accordingly, there is a need for a hay bale dryer, such that damp hay may be baled and processed to a desired moisture content through use of the hay bale dryer. It may be further beneficial to employ a hay bale dryer which is able to dry a bale of hay at a low cost and without changing the shape or appearance of the bale.

SUMMARY

According to an embodiment, there is provided a hay bale dryer including a support frame; an upper air intake manifold movably coupled to the support frame for supplying heated air, the upper air intake manifold comprising an upper air chamber and a plurality of hollow needles extending downwardly therefrom, the needles having a series of apertures therein, the apertures allowing the heated air to exit; an lower air intake manifold movably coupled to the support frame for supplying heated air, the lower air intake manifold comprising an air chamber and a plurality of hollow needles extending upwardly therefrom, the needles having a series of spaced apertures therein, the apertures allowing the heated air to exit; a bale retainer fixedly coupled to the support frame between the upper air chamber and the lower air chamber, the bale retainer being configured for retaining at least one hay bale in a fixed position between the upper air chamber and the lower air chamber, the bale retainer comprising an horizontally extending upper bale retaining member and a horizontally extending lower bale retaining member spaced from the upper bale retaining member a vertical distance defining a bale space sized to receive the at least one hay bale, the bale retaining members having openings that allow the plurality of needles to enter the bale space; and an actuator coupled to the upper air intake manifold and the lower air intake manifold, the actuator being configured for moving the upper air intake manifold and the lower air intake manifold between a retracted positon in which the needles are retracted outside the bale space and an extended positon in which the needles extend through the openings into the bale space.

The hollow needles of the upper air intake manifold may terminate in a common first needle plane a first needle length from the upper air intake manifold, and the hollow needles of the lower air intake manifold may terminate in a common second needle plate a second needle length from the lower air intake manifold.

The hollow needles of the upper air intake manifold and the hollow needles of the lower air intake manifold may terminate in tapered points.

The series of apertures in each needle of the hollow needles of the upper air intake manifold and the hollow needles of the lower air intake manifold may be aligned along the length of each needle with the apertures in each series of apertures decreasing in size from the aperture nearest the air chamber to the aperture farthest from the air chamber.

The actuator may include a pair of parallel vertical linear actuators each coupled to the upper air intake manifold and the lower air intake manifold and spaced on opposite sides of the bale space.

The linear actuators may be hydraulic cylinders.

The upper air intake manifold may include an upper manifold coupling assembly for moveably coupling the upper air chamber to the support frame, the lower air intake manifold may include a lower manifold coupling assembly for movably coupling the lower air chamber to the support frame, and the actuator may extend between the upper manifold coupling assembly and the lower manifold coupling assembly.

The support frame may include a pair of vertical support frame members on each end of the support frame, the upper manifold coupling assembly may include a pair of upper end frames extending outwards from end walls of the upper air chamber, and the lower manifold coupling assembly may include a pair of lower end frames extending outwards from end walls of the lower air chamber. Each upper and lower end frame may be configured to be movably coupled to the vertical support frame members and each pair of vertical support frame members may be spaced from one another.

Each of the vertical support frame members may include an upper vertical track set and a lower vertical track set and each of the upper and lower coupling assemblies may include a pair of track gears rigidly attached to the each upper and lower end frame. Each track gear may be configured to mesh with a respective vertical track set of the vertical support frame members to movably couple each upper and lower end frame to the vertical support frame members.

The upper coupling assembly may also include a pair of upper drive shafts extending from one upper end frame through the upper air chamber to the other upper end frame, and the lower coupling assembly may also include a pair of lower drive shafts extending from one lower end frame through the lower air chamber to the other lower end frame. The upper drive shafts may be spaced from one another and the lower drive shafts may be spaced from one another such that the upper and lower manifold coupling assemblies are balanced from end-to-end during movement between the retracted positon and the extended positon.

The upper coupling assembly may also include a pair of upper balancing gears rigidly attached to each upper end frame near an end of a respective track gear, an upper idler gear attached to a central portion of each upper end frame and an upper synchronization chain extending around the upper balancing gears and the upper idler gear of each upper end frame, and the lower coupling assembly may also include a pair of lower balancing gears rigidly attached to each lower end frame near an end of a respective track gear, a lower idler gear attached to a central portion of each lower end frame and a lower synchronization chain extending around the lower balancing gears and the lower idler gear of each lower end frame.

The upper and lower bale retaining members may be racks formed of parallel and perpendicular beams with gaps between the beams through which the needles of the upper and lower pluralities of needles may pass.

The upper and lower bale retaining members may be plates having a plurality of apertures through which the needles of the upper and lower pluralities of needles may pass.

According to a another embodiment, there is provided an apparatus for drying bales, including a support frame; at least one air intake manifold movably coupled to the support frame for supplying heated air, the air intake manifold comprising an air chamber and a plurality of hollow needles extending therefrom, the needles having a series of apertures therein, the apertures allowing the heated air to exit; a bale retainer fixedly coupled to the support frame, the bale retainer being configured for retaining at least one bale in a fixed position vertically spaced from the at least one air intake manifold, the bale retainer defining a bale space sized to receive the at least one bale, the bale retainer having openings that allow the plurality of needles to enter the bale space; and an actuator coupled to the at least one air intake manifold, the actuator being configured for moving the at least one air intake manifold between a retracted positon in which the needles are retracted outside the bale space and an extended positon in which the needles extend through the openings into the bale space.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below.

Figure 1:
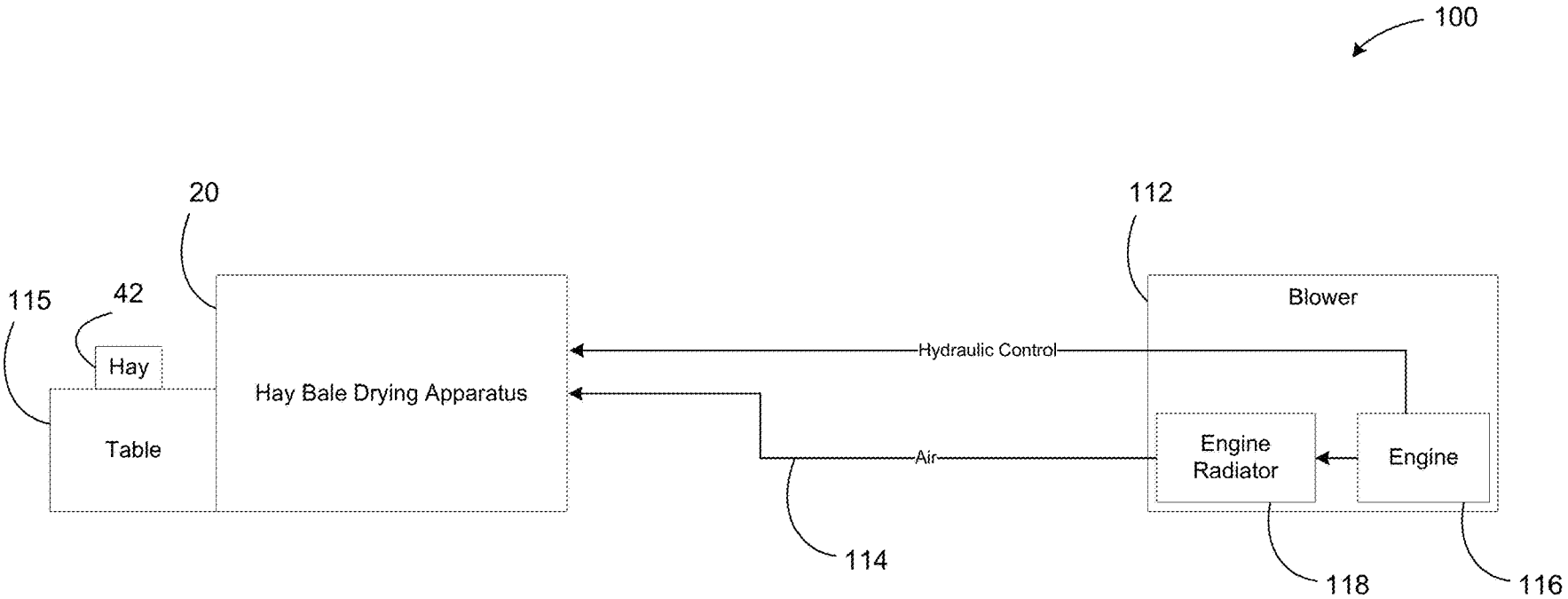
FIG. 1 shows a schematic diagram of a system for drying hay bales.

By way of general overview, FIG. 1 shows a system 100 for drying hay bales. System 100 includes a blower 112, a table 115 and a hay bale drying apparatus 20.

Blower 112 includes an engine 116, such as a 275 horse power 6.8 liter diesel engine. Engine 116 draws in ambient air to be used by or in hay bale drying apparatus 20. Engine 116 can provide sufficient pressure to blow air through apparatus 20 into hay bales placed within a bale space 48 of hay bale drying apparatus 20 when upper and lower air intake manifolds 24 and 26 are in extended positions with upper and lower pluralities of needles 30 and 34 extended into bale space 48. Engine 116 is be configured or chosen or built or modified so as to provide an air pressure sufficient to push air through the hay bales.

Table 115 is removably coupled to hay bale drying apparatus 20 and configured to support at least one bale of hay. Table 115 can be any appropriate structure capable of supporting one or more bales of hay 42. Table 115 can include a conveyor belt, rollers or the like for use in providing bales of hay 42 to the hay bale drying apparatus 20 for drying.

Further details of the operation of blower 112, table 115 and hay bale drying apparatus 20 are provided below.

Figure 2:
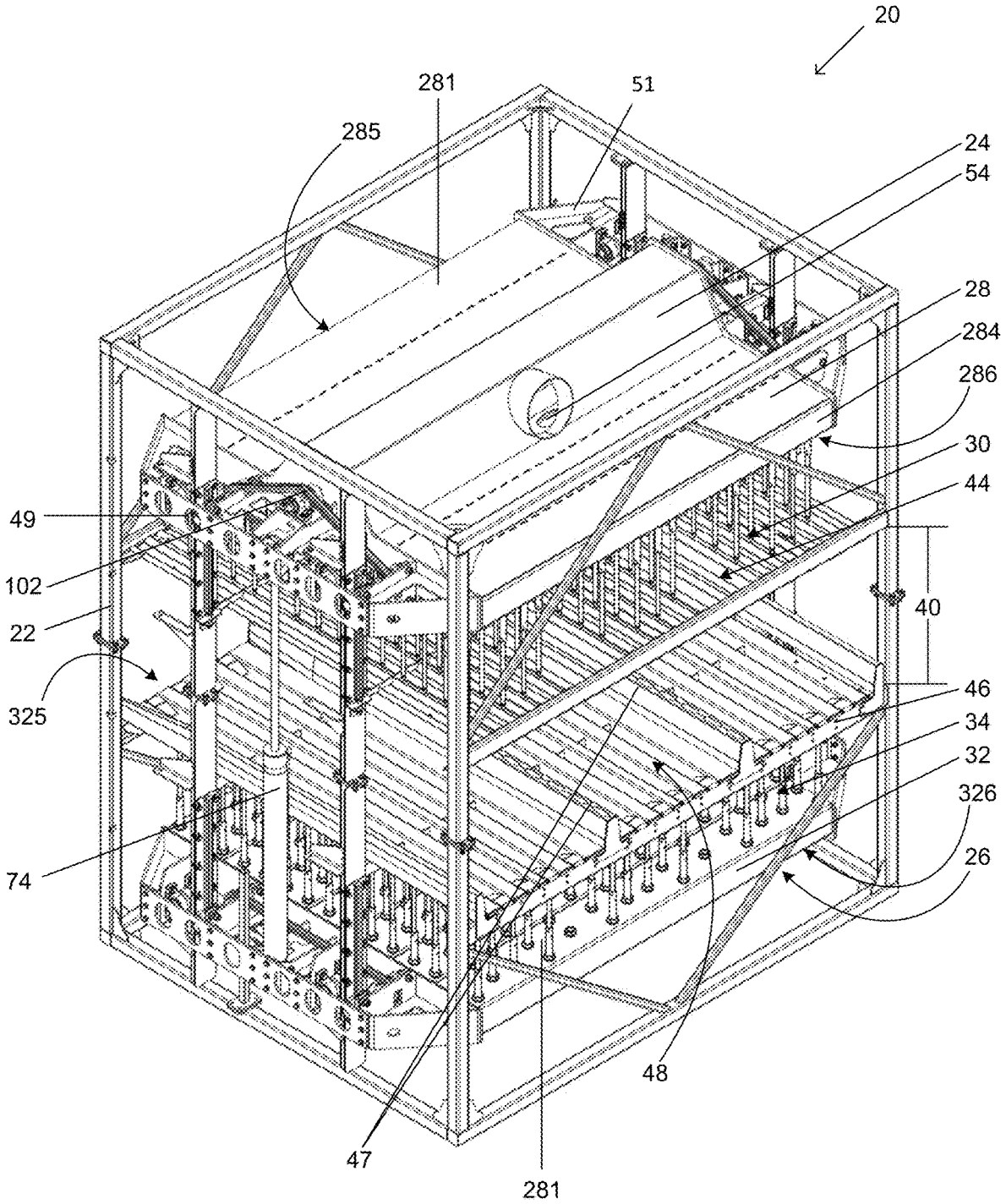
FIG. 2 shows a perspective view of an apparatus for drying hay bales of the system of FIG. 1 having a plurality of needles in a retracted position.
Figure 3:
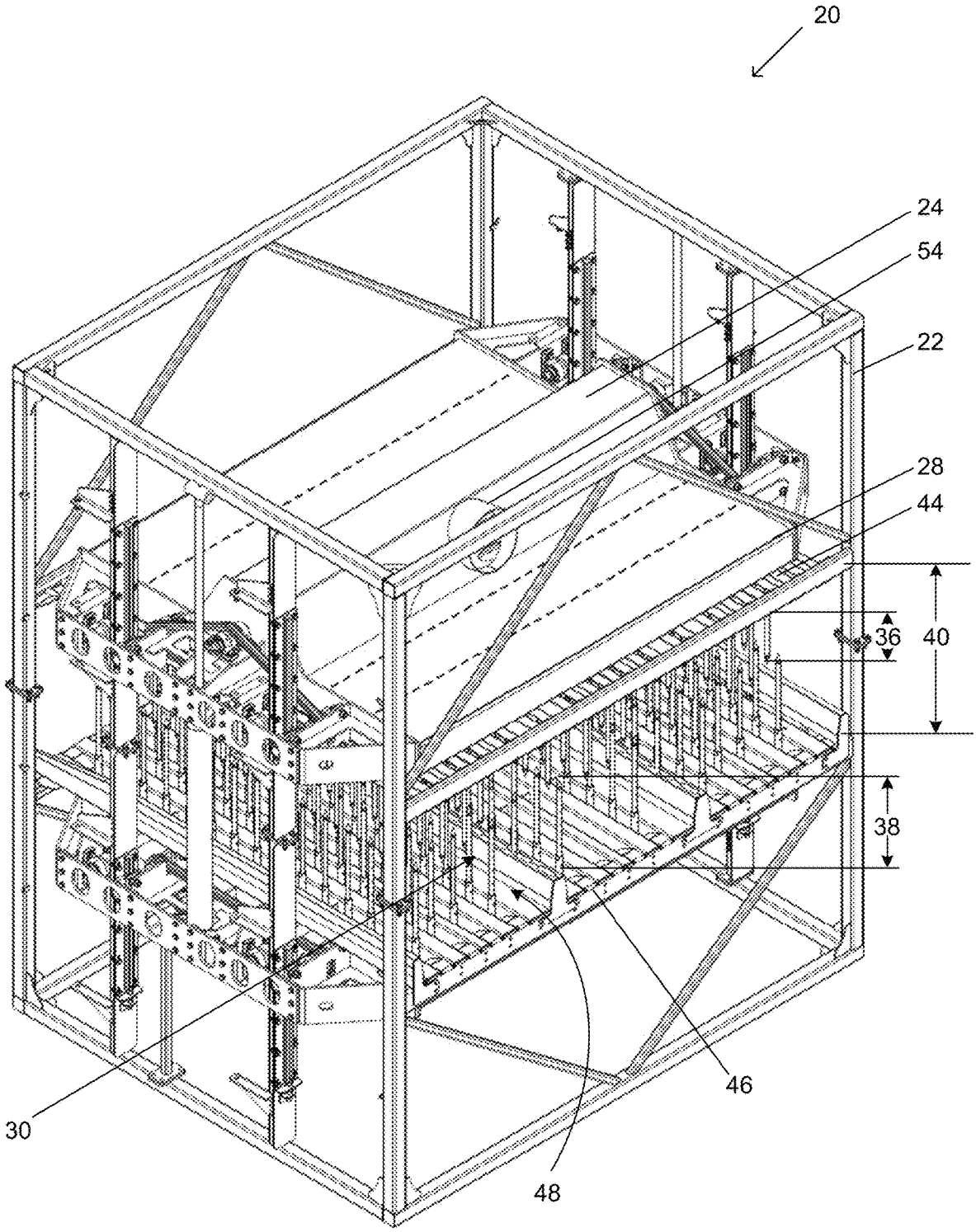
FIG. 3 shows a perspective view of the apparatus for drying hay bales of FIG. 2 having a plurality of needles in an extended position.
Figure 5:
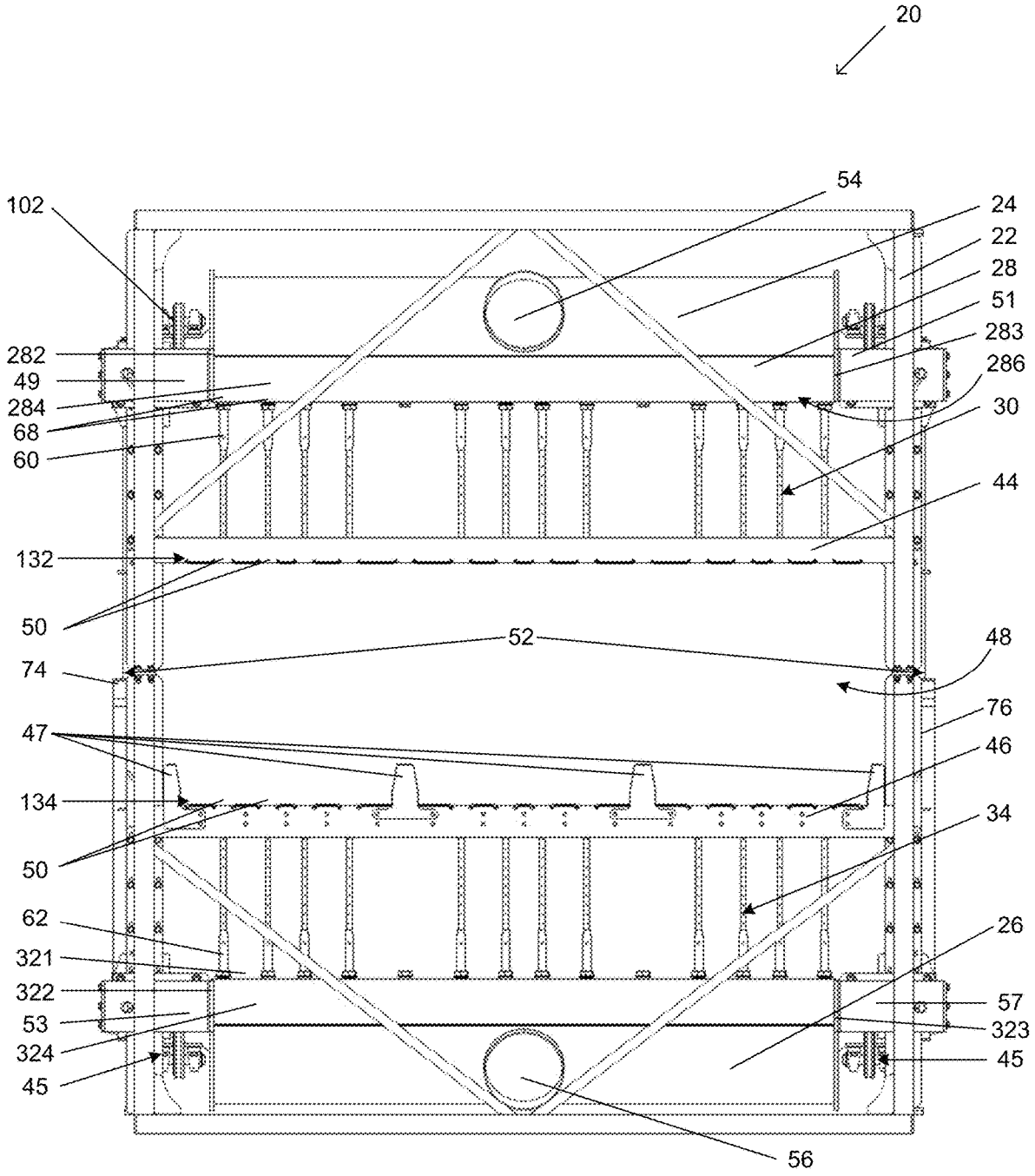
FIG. 5 shows a side view of the apparatus of FIG. 2.

FIGS. 2, 3, 5 and 6 show various embodiments of the subject hay bale drying apparatus 20. Specifically, FIG. 2 shows a perspective view of a hay bale drying apparatus 20 in an open configuration and FIG. 3 shows a perspective view of a hay bale drying apparatus 20 in a closed configuration. Hay bale drying apparatus 20 has a support frame 22. Supported by support frame 22 are an upper air intake manifold 24 and a lower air intake manifold 26. Upper air intake manifold 24 includes an upper air chamber 28 and lower air intake manifold 26 includes a lower air chamber 32. As shown in FIGS. 2 and 5, upper air chamber 28 is defined by an upper top wall 281, an upper first end wall 282, an upper second end wall 283, an upper front wall 284, an upper back wall 285 and an upper bottom wall 286. An upper plurality of hollow needles 30 extends downwardly from upper bottom wall 286 of upper air intake chamber 28. Lower air chamber 32 is defined by a lower top wall 321, a lower first end wall 322, a lower second end wall 323, a lower front wall 324, a lower back wall 325 and a lower bottom wall 326. A lower plurality of hollow needles 34 extends upwardly from lower top wall 321. Upper plurality of hollow needles 30 may terminate in a common needle plane a first needle length 36 from upper air chamber 28, as shown particularly in FIG. 3. Lower plurality of hollow needles 34 may terminate in a common needle plane a second needle length 38 from lower air chamber 32, also shown in FIG. 3.

A bale retainer 40 is fixedly coupled to frame 22 between upper air chamber 28 and lower air chamber 32 to retain at least one hay bale 42 in a fixed vertical position between upper air chamber 28 and lower air chamber 32. Bale retainer 40 includes a horizontally extending upper bale retaining member 44 and a horizontally extending lower bale retaining member 46 spaced from upper bale retaining member 44 a vertical distance defining a bale space 48 sized to receive the at least one hay bale 42. Each of upper and lower bale retaining members 44 and 46 have openings 50 that provide for the upper and lower pluralities of needles 30 and 34 to enter the bale space 48. Each of upper and lower bale retaining members 44 and 46 may be vertically fixed in position, or may be movable such that the size of bale space 48 may be adjusted.

Figure 4:
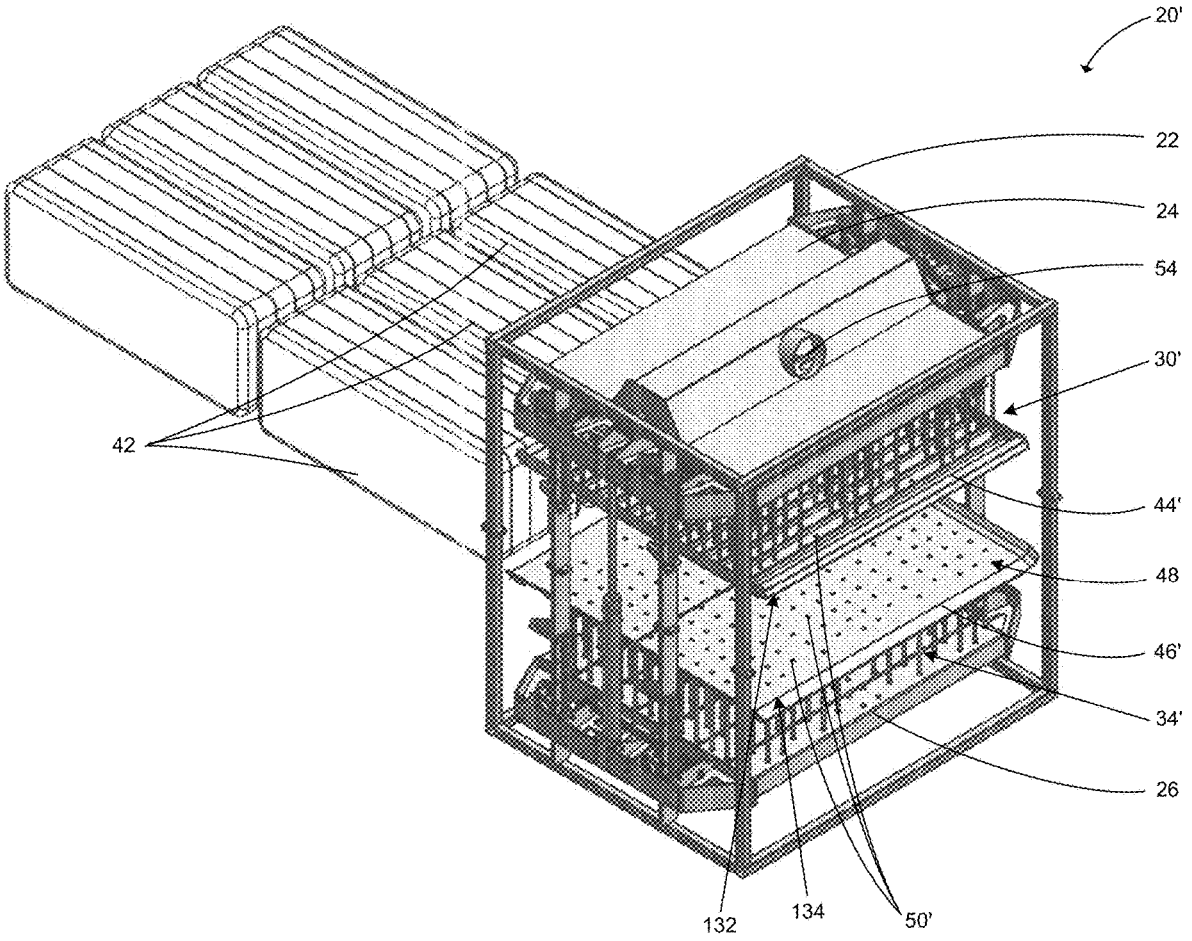
FIG. 4 shows a perspective view of another apparatus for drying hay bales having plates for receiving bales of hay.

As shown in FIGS. 2 and 3, upper and lower bale retaining members 44 and 46 may be racks or frameworks with gaps between members or beams of the racks or frameworks permitting the needles of upper and lower pluralities of needles 30 and 34, respectively, to pass through. FIG. 4 shows an alternate embodiment of a hay bale drying apparatus 20' where upper and lower bale retaining members 44' and 46' are plates having a plurality of apertures, with one aperture 50' being positioned to register with each needle 70' of upper and lower pluralities of needles 30', 34', respectively. A rack or framework may provide better air and moisture flow than a plate, and may make it easier to switch bale size and needle configurations. Alternatively, a plate may assist in controlling air flow.

Each of upper and lower air intake manifolds 24 and 26 are moveable between a retracted position, in which upper and lower pluralities of needles 30 and 34, respectively, are retracted outside bale space 48, and an extended position, in which upper and lower pluralities of needles 30 and 34, respectively, extend through openings 50 into bale space 48. The retracted and extended positions of the upper and lower plurality of needles 30 and 34 are shown in FIGS. 5 and 6, respectively.

Figure 6:
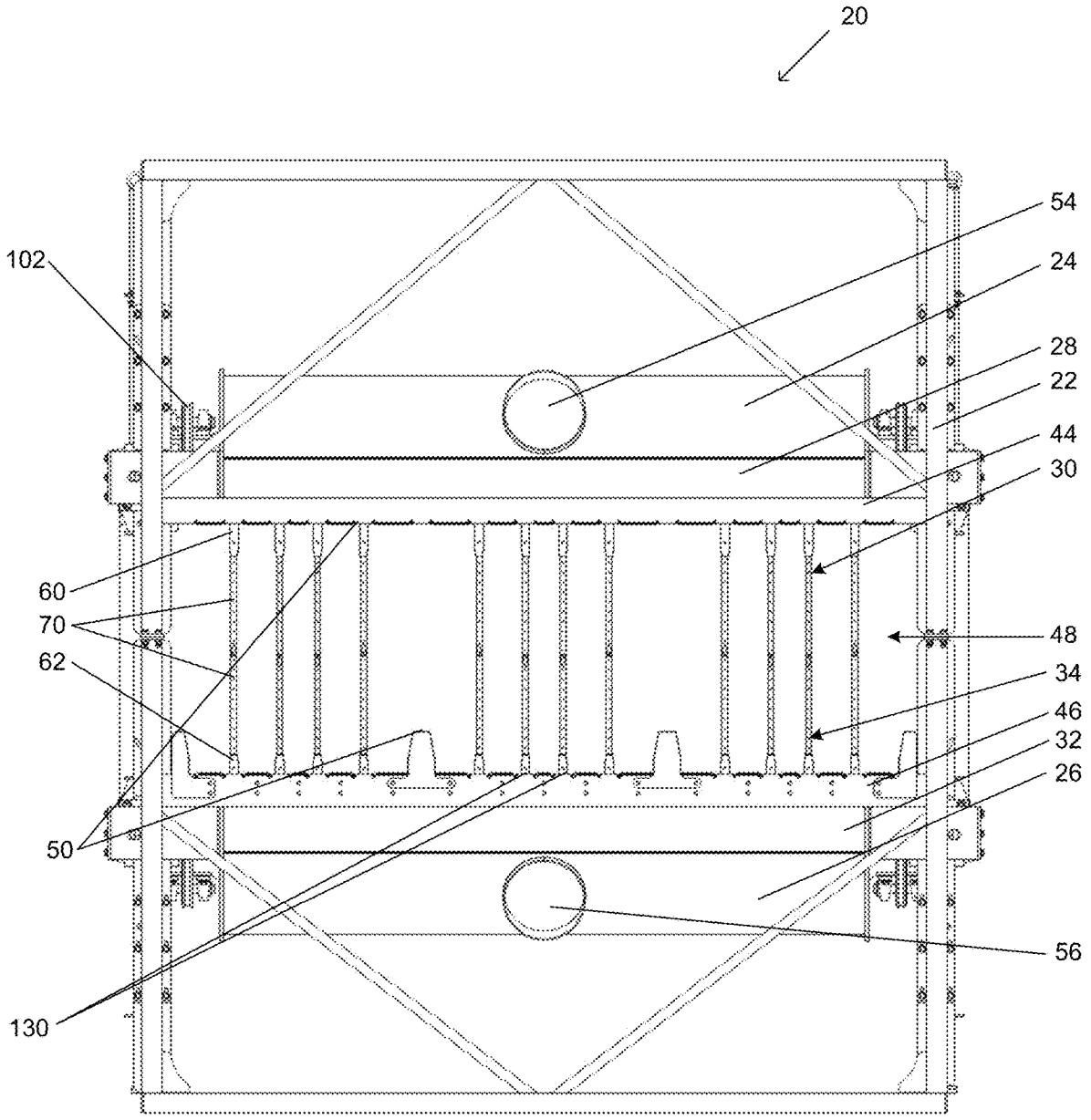
FIG. 6 shows an end view of the apparatus of FIG. 3.

Also shown in FIGS. 5 and 6, lower bale retaining member 46 can also comprise one or more dividers 47. Dividers 47 extend vertically from lower bale retaining member 46 into bale space 48. Dividers 47 are spaced from each other horizontally on lower bale retaining member 46 to channel individual bales of hay passing from table 115 into bale space 48 for drying. Dividers 47 can also have openings 50 that provide for the lower pluralities of needles 34 to enter the bale space 48 (see for example FIG. 6).

Upper air chamber 28 has an upper air intake opening 54 and lower air intake chamber 32 has a lower air intake opening 56. Each of upper and lower air chambers 28 and 32 may include internal baffles (not shown) to direct air flow.

Figure 12B:
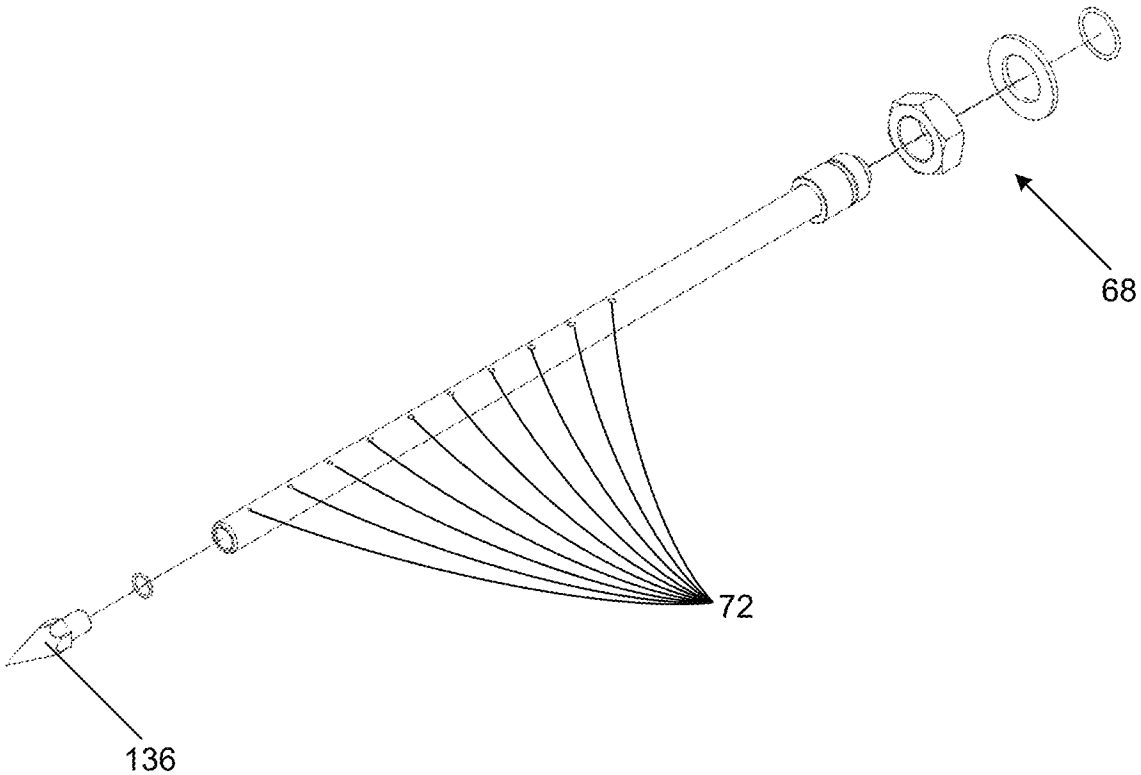
FIG. 12B shows an exploded perspective view of the needle of FIG. 12A.
Figure 12A:
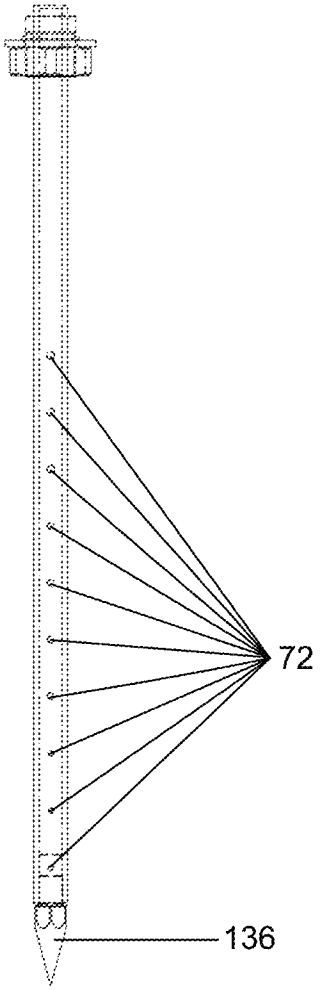
FIG. 12A shows a front view of a needle of the apparatus of FIG. 2.

Upper plurality of needles 30 are fluidly connected to upper air chamber 28 at the upper ends 60 of the needles 70 of upper plurality of needles 30, such as by way of needle bases 68, as shown in FIGS. 5 and 6. Needles 70 of upper plurality of needles 30 are hollow and aligned with apertures (not shown) in upper bottom wall 286 of upper air chamber 28. Lower plurality of needles 34 are fluidly connected to lower air chamber 32 at the lower ends 62 of the needles of lower plurality of needles 34, such as by way of needle bases 68, also shown in FIGS. 5 and 6. Needles 70 of lower plurality of needles 34 are also hollow and aligned with apertures (not shown) in lower top wall 321 of lower air chamber 32. Each needle 70 of upper and lower pluralities of needles 30, 34, as shown in FIGS. 12A and 12B, has apertures 72 therein, permitting air pushed into the upper and lower air intake chambers 28 and 32, respectively, to exit from upper and lower air intake manifolds 24 and 26, respectively, through apertures 72 in the needles of upper and lower pluralities of needles 30 and 34. Needles 70 are further described below.

An actuator 52 is coupled to the upper air intake manifold 24 and the lower air intake manifold 26. Actuator 52 moves the upper air intake manifold 24 and the lower air intake manifold 26 between a retracted position, in which the upper and lower pluralities of needles 30 and 34 are retracted outside the bale space 48, such as shown in FIG. 5, and an extended position, in which the upper and lower pluralities of needles 30 and 34 extend through openings 50 into bale space 48, such as shown in FIG. 6.

Actuator 52 comprises at least one hydraulic cylinder to move the upper air intake manifold 24 and lower air intake manifold 26 between the retracted and extended positions. In the embodiments shown in the Figures, actuator 52 comprises a first hydraulic cylinder 74 and a second hydraulic cylinder 76. Each of the first hydraulic cylinder 74 and second hydraulic cylinder 76 is coupled to upper air intake manifold 24 and lower air intake manifold 26. First and second hydraulic cylinders 74 and 76 are parallel, spaced across bale space 48 from one another, and oriented substantially vertically or perpendicular to upper and lower bale retaining members 44 and 46. In this configuration, actuation of either or both of hydraulic cylinders 74, 76 can move the upper air intake manifold 24 and lower air intake manifold 26 between the retracted and extended positions. In one embodiment, hydraulic cylinders 74 and 76 may be between 1 and 10 inch hydraulic cylinders, and more specifically between 2 and 4 inch hydraulic cylinders. Larger cylinders may be more expensive and bulkier, but may provide more force to drive needles 70 of upper and lower pluralities of needles 30 and 34 into hay bales placed within bale space 48.

Figure 7:
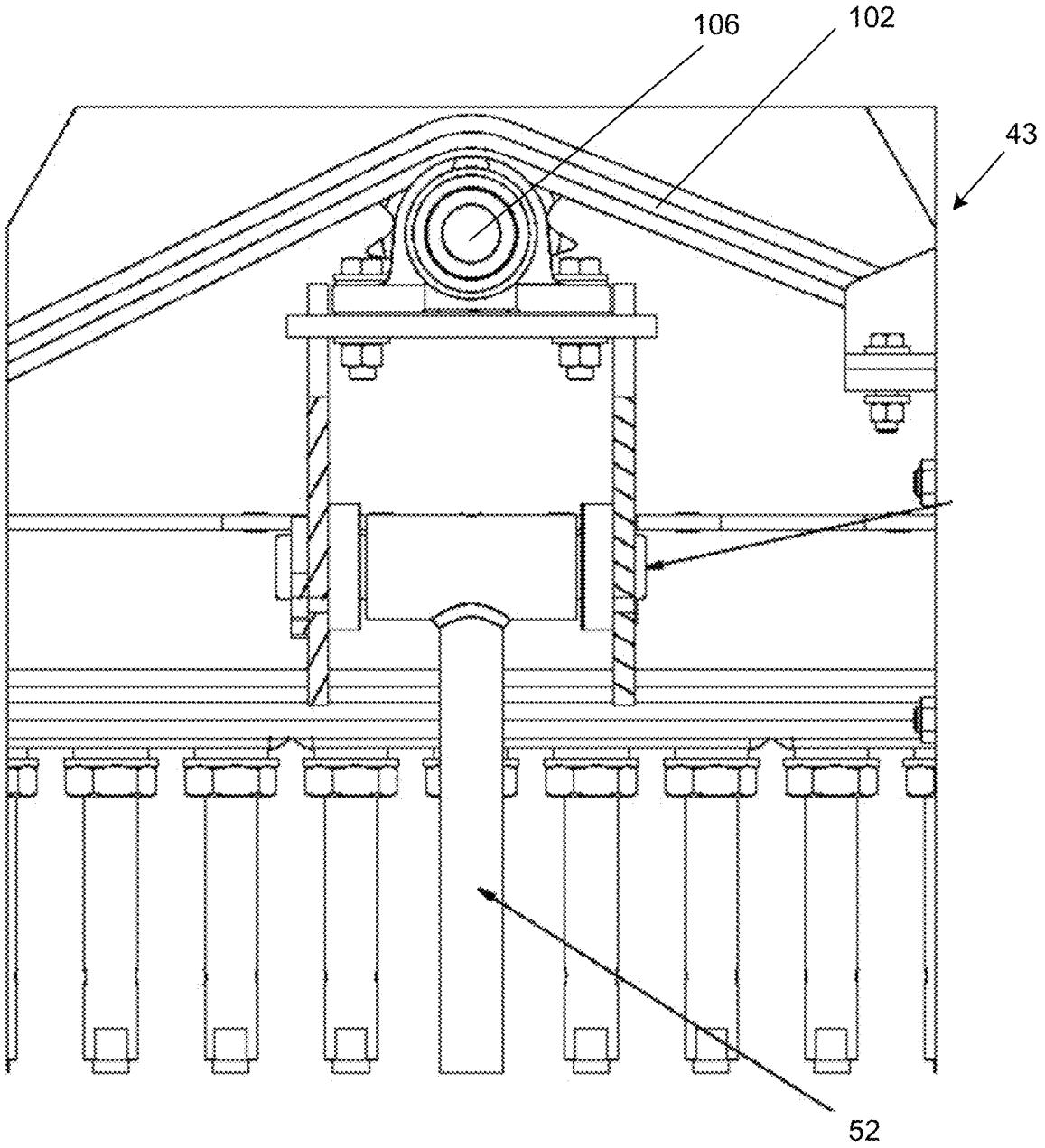
FIG. 7 shows an elevated end view of a portion of the apparatus of FIG. 2.
Figure 8:
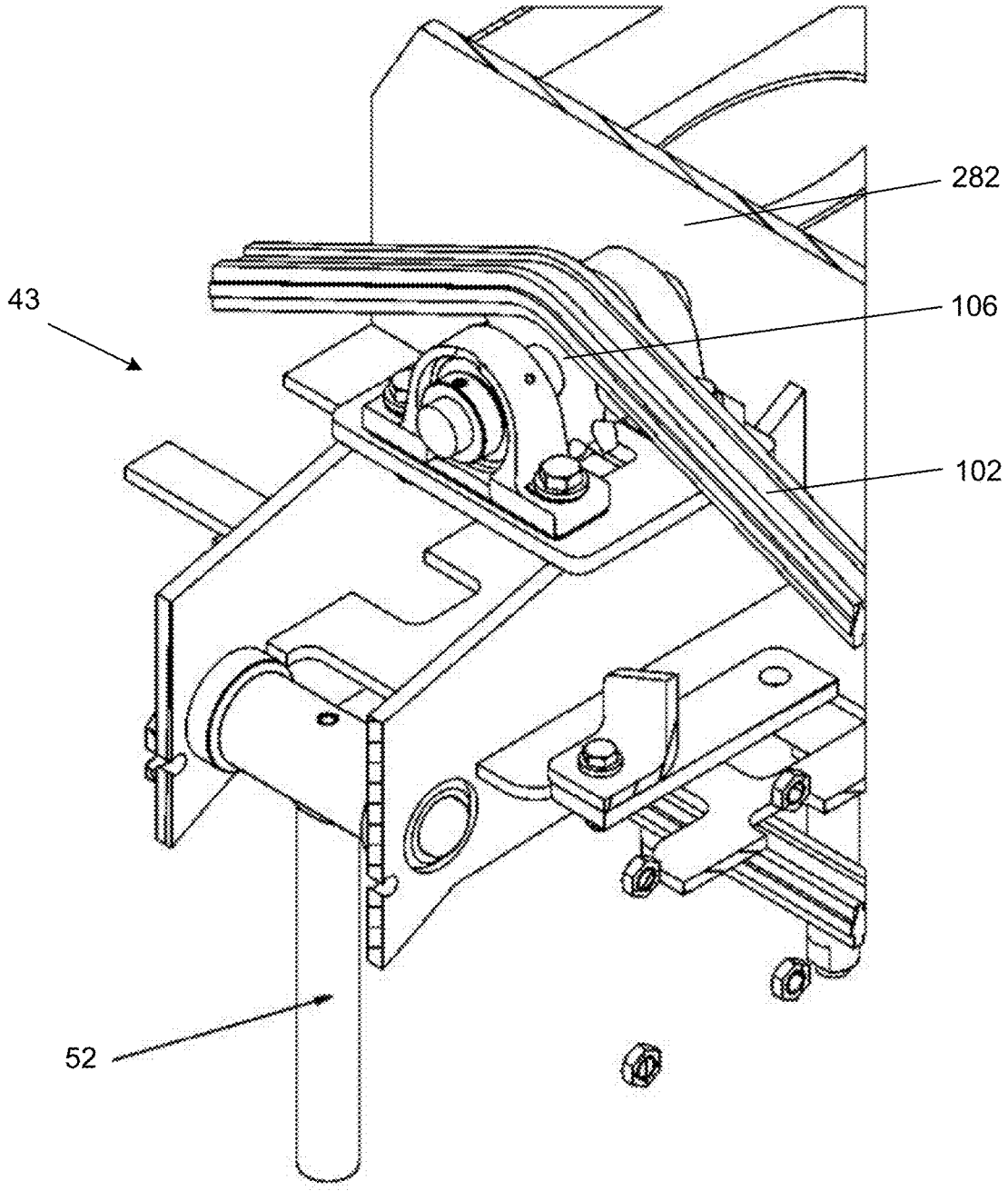
FIG. 8 shows a perspective view of a portion of the apparatus of FIG. 2.

Referring now to FIGS. 7, 8 and 9, upper air intake manifold 24 comprises an upper manifold coupling assembly 43. Upper manifold coupling assembly 43 moveably couples the upper air chamber 28 to the support frame 22. Upper manifold coupling assembly 43 also provides side-to-side and end-to-end balancing of upper air intake manifold 24 as it moves between the retracted and extended positions. Upper manifold coupling assembly 43 includes an upper balancing assembly 61 (see FIG. 9B), first upper end frame 49, second upper end frame 51, two track gears 101 and a wheel 106, each of which is described below in greater detail.

Figure 9A:
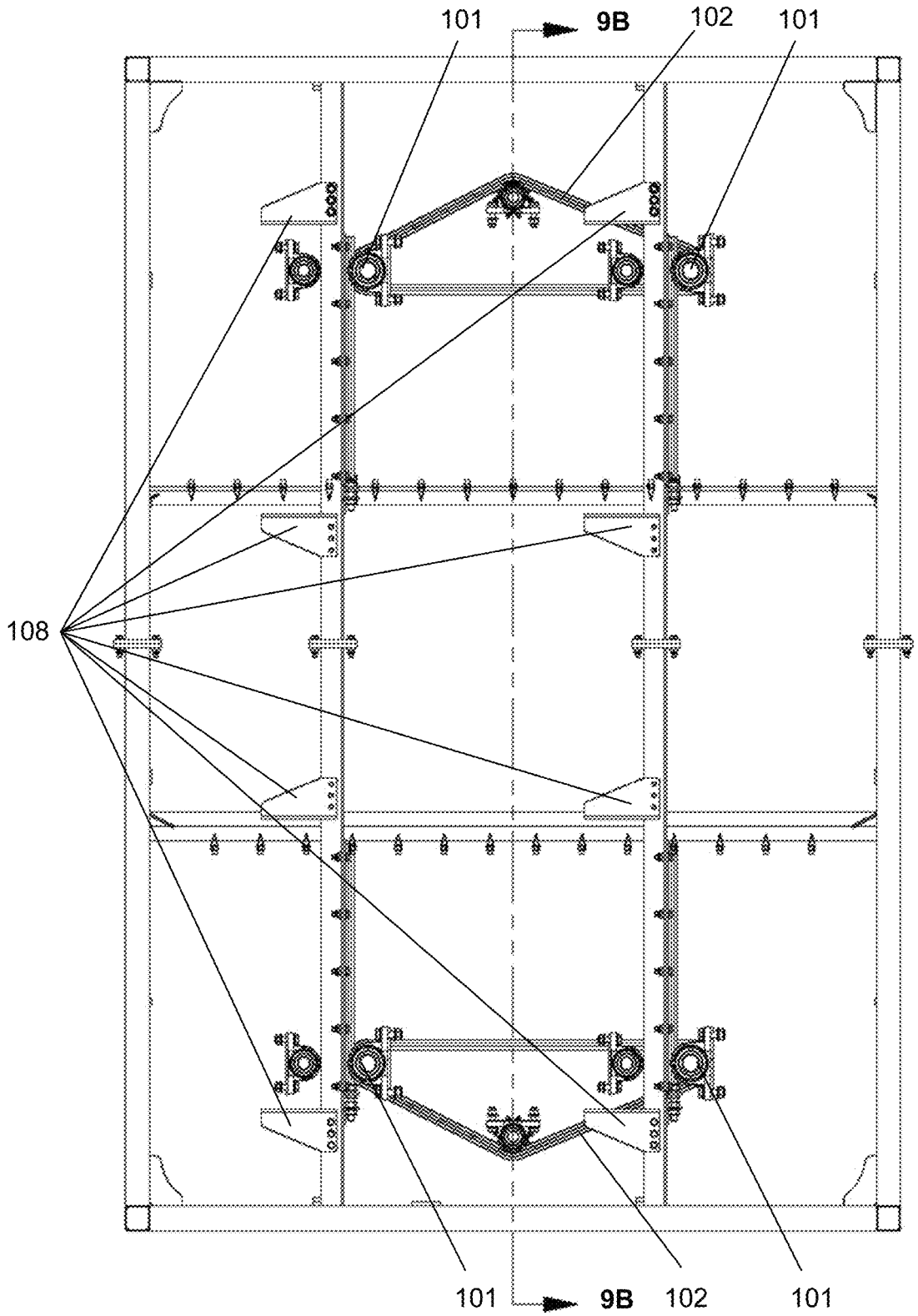
FIG. 9A shows a side view of balancing assembly of the apparatus of FIG. 2.
Figure 9B:
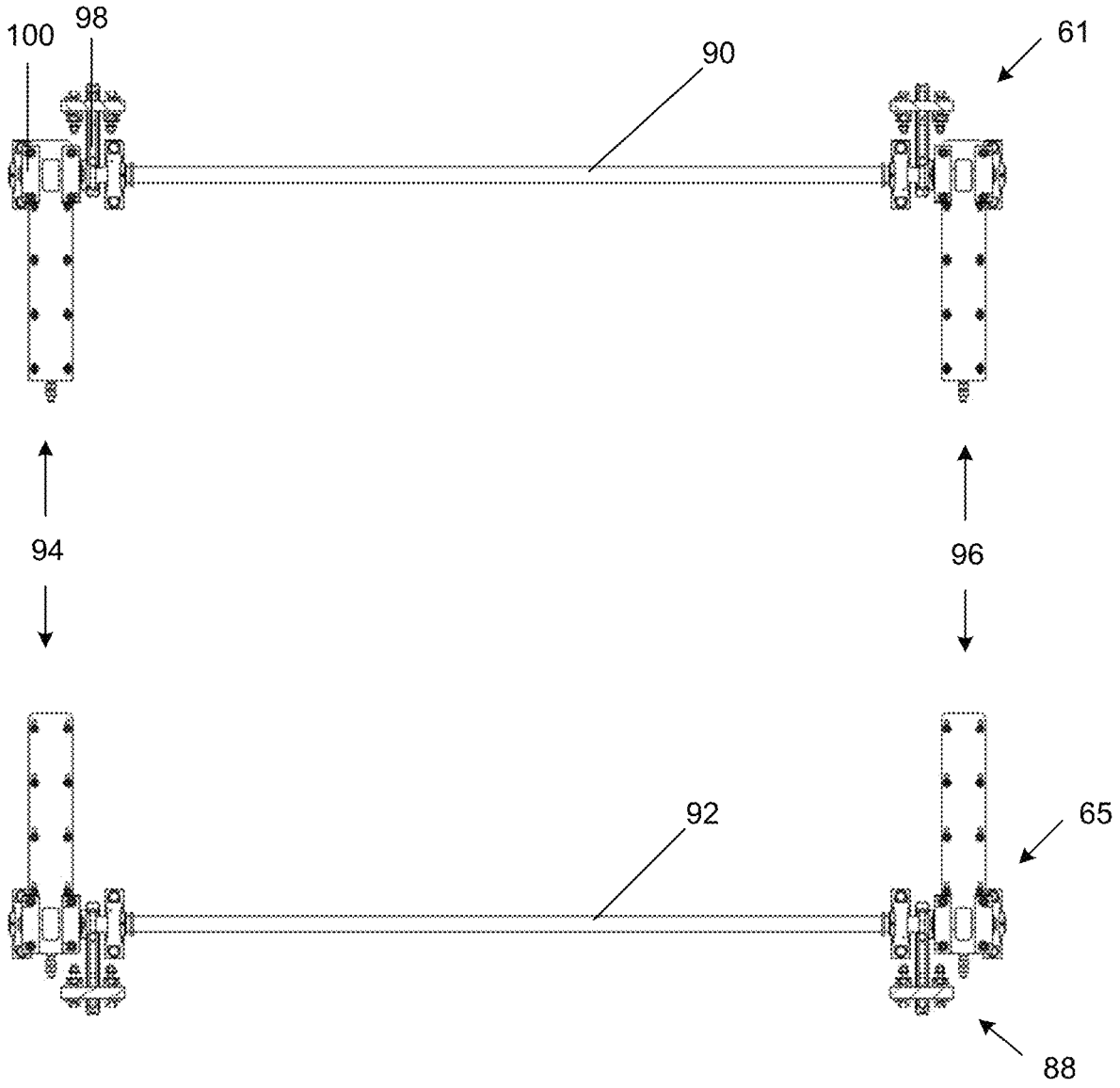
FIG. 9B shows a cross-section view of the carriage and frame of the apparatus of FIG. 2 along the line 9B-9B indicated in FIG. 9A.

Lower air intake manifold 26 includes a lower manifold coupling assembly 45 (see FIG. 9A). Lower manifold coupling assembly 45 movably couples the lower air chamber 32 to the support frame 22. Lower manifold coupling assembly 45 also provides side-to-side and end-to-end balancing of lower air intake manifold 26 as it moves between the retracted and extended positions. Lower manifold coupling assembly 45 includes a lower balancing assembly 65, first upper end frame 53, second upper end frame 57, two track gears 101 and a wheel 106, each of which is also described below in greater detail.

First hydraulic cylinder 74 and second hydraulic cylinder 76 extend between the upper manifold coupling assembly 43 and the lower manifold coupling assembly 45.

Support frame 22 includes four vertical support frame members 55 arranged such that each end of the support frame 22 has a pair of vertical support frame members 55 spaced apart from one another. Each vertical frame member 55 has a vertical track set 63 including an upper track set 82 and a lower track set 84.

First upper end frame 49 is secured to and extends outward from upper end wall 282 of upper air chamber 28 and second upper end frame 51 is secured to and extending outwards from upper end wall 283 of upper air chamber 28. Likewise, first lower end frame 53 is secured to and extends outward from lower end wall 322 of lower air chamber 32 and a second lower end frame 57 secured to and extending outward from lower end wall 323 of lower air chamber 32. Upper end frame 49 and lower end frame 53 are each configured to be movably coupled to one pair of vertical support frame members 55 and upper end frame 51 and lower end frame 57 are each configured to be movably coupled to the other pair of vertical support members 55.

Figure 9C:
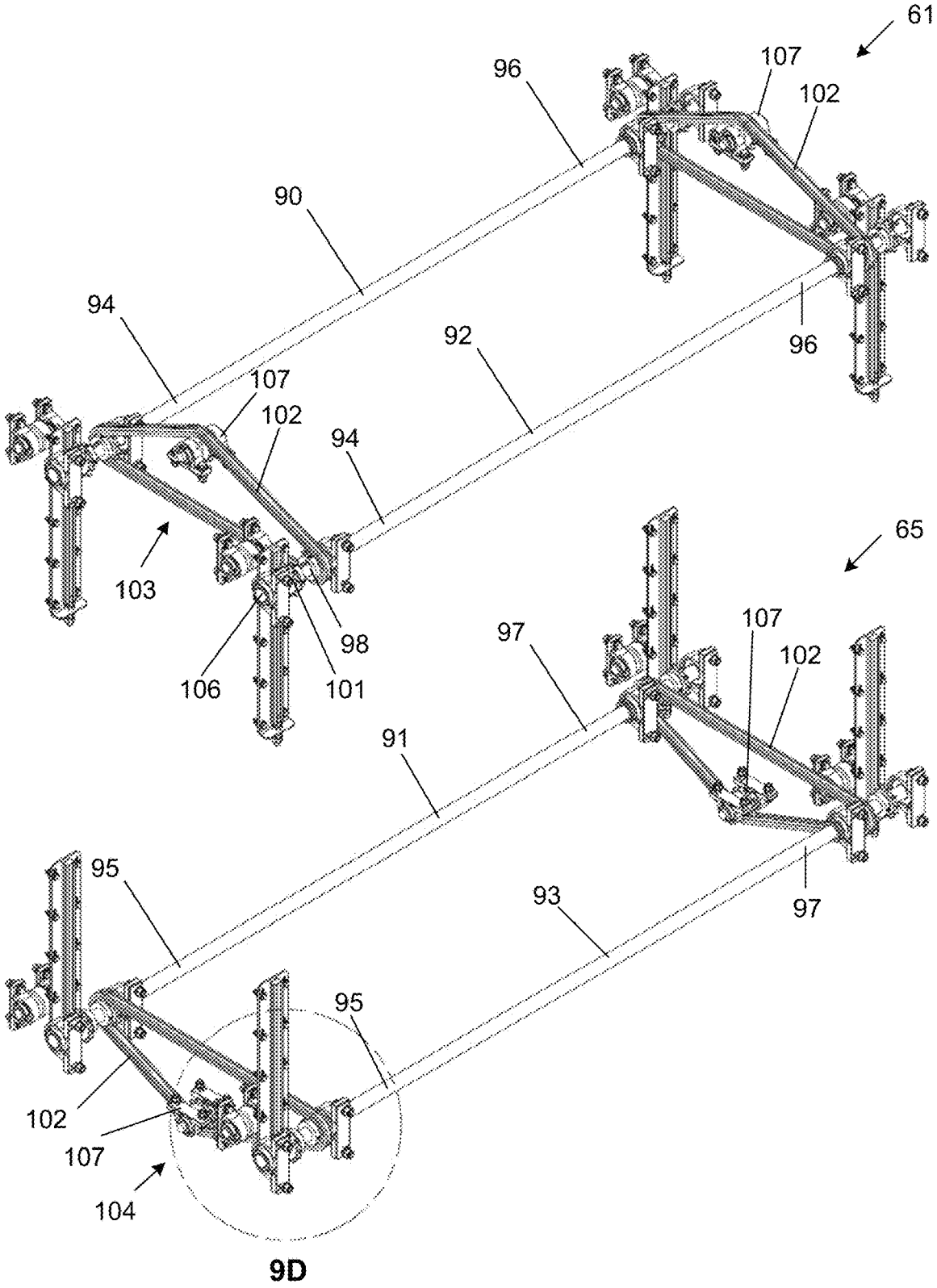
FIG. 9C shows a perspective view of the balancing assembly of the apparatus of FIG. 2.
Figure 9D:
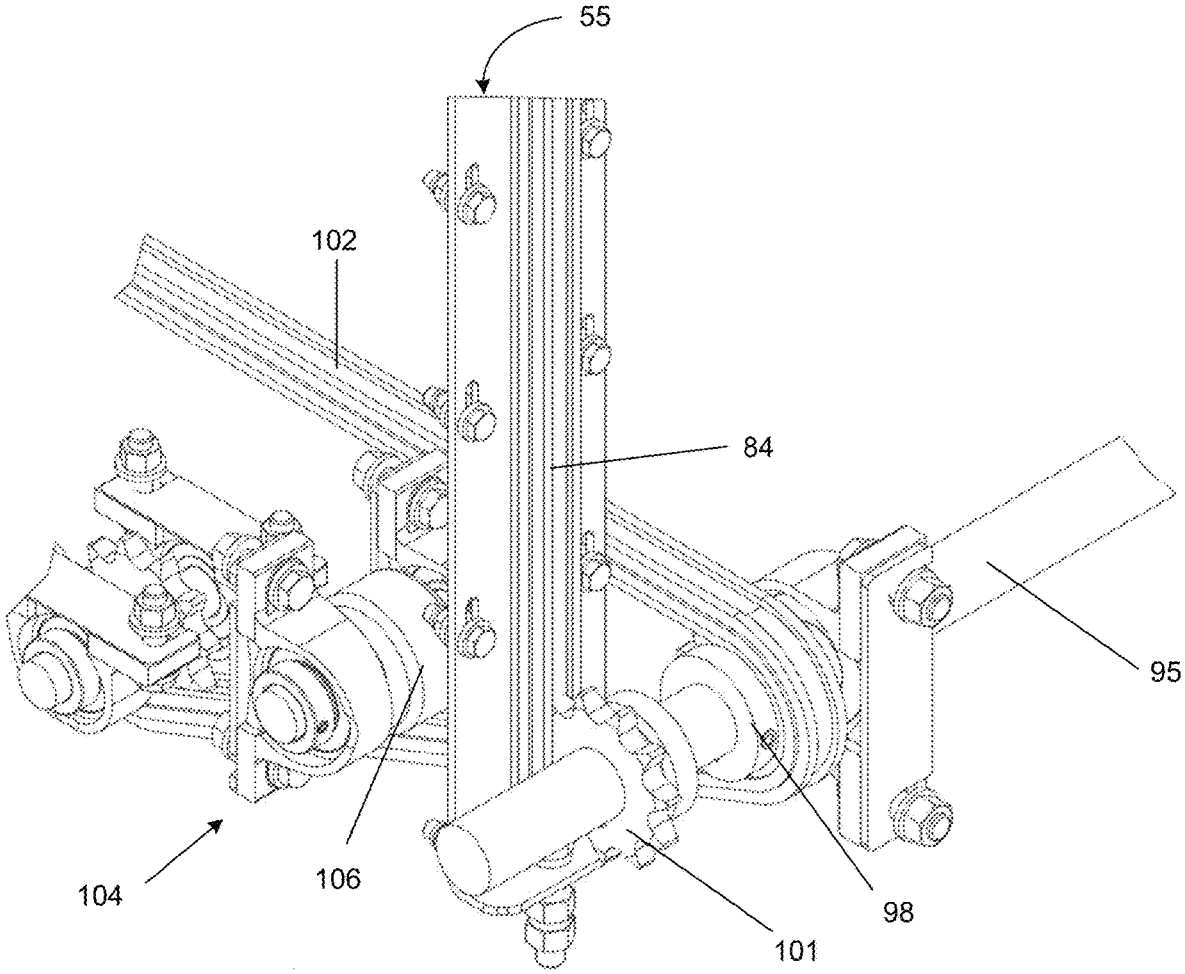
FIG. 9D shows a perspective view of a portion of the balancing assembly within the circle 9D in FIG. 9C.

As shown in FIG. 9D, each upper and lower track set 82, 84 is fixedly coupled to a vertical frame member 55 of frame 22 and engages (e.g. meshes with) a track gear 101 that is rigidly attached to a respective drive shaft 90, 91, 92, 93 near a respective end frame 49, 51, 53, 57. In the embodiments shown in the Figures, upper and lower track sets 82, 84 are tracks and track gears 101 are toothed gears that fit between the tracks, however any appropriate configuration providing movable coupling between a respective track set track gear may be used.

Figure 9E:
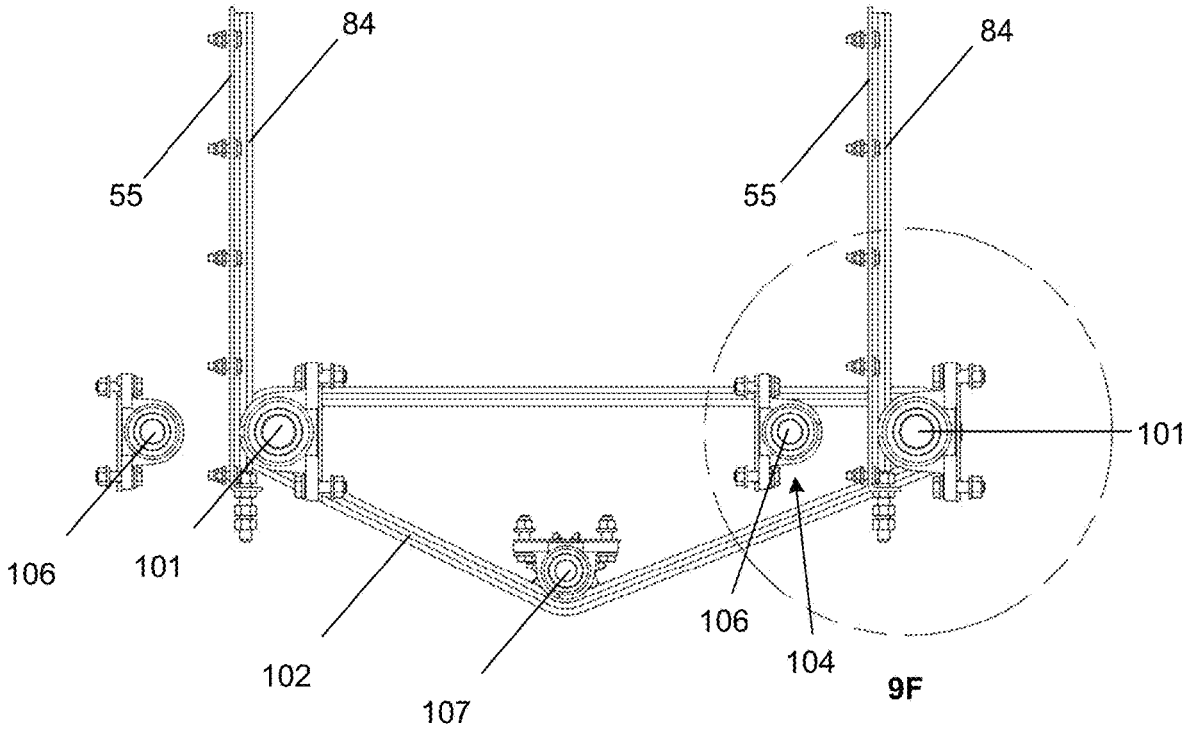
FIG. 9E shows a side view of a portion of the balancing assembly of the apparatus of FIG. 2.
Figure 9F:
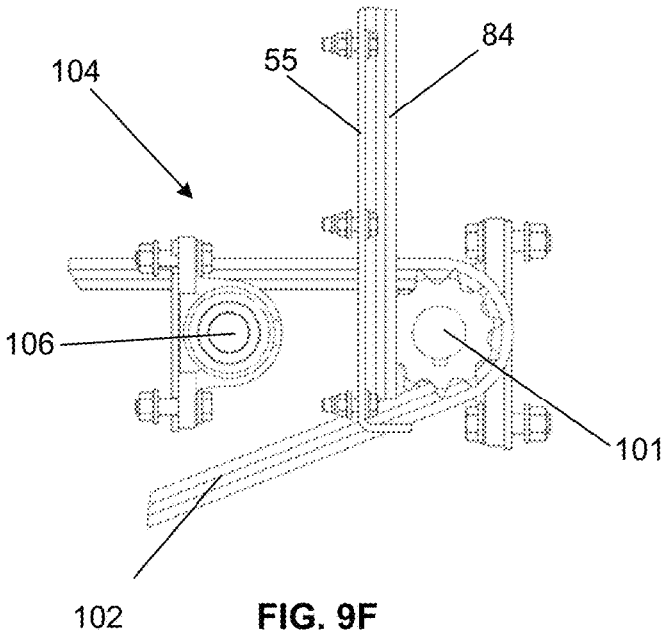
FIG. 9F shows a side view of the portion of the balancing assembly within the circle 9F in FIG. 9E.
Figure 10B:
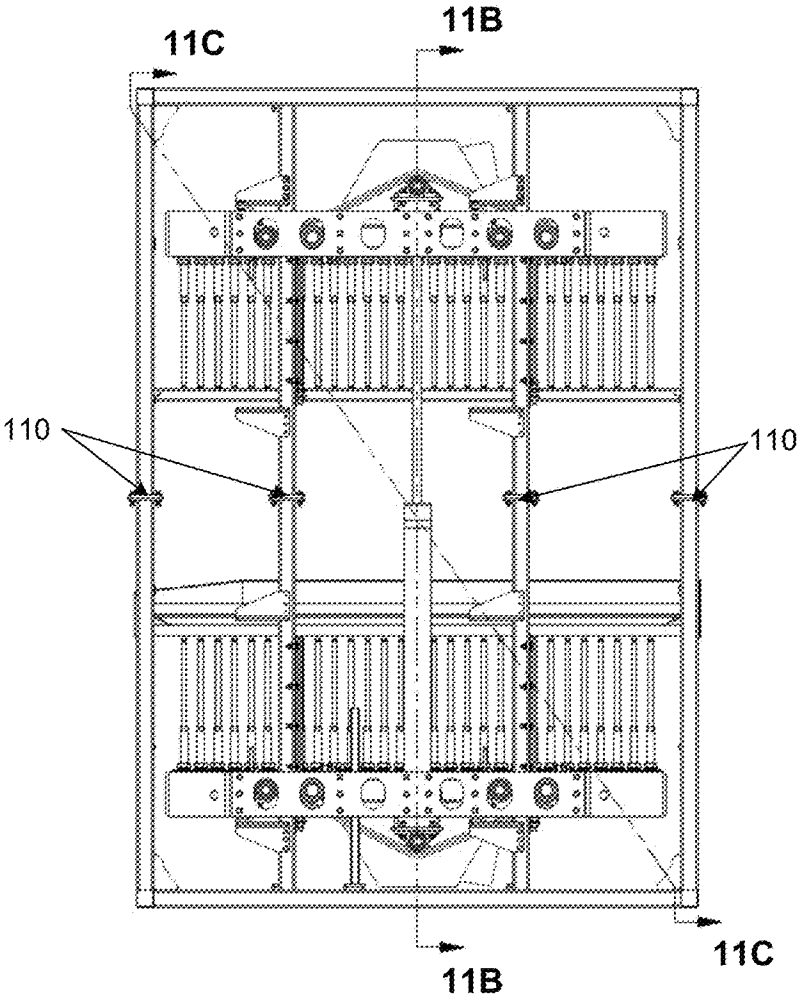
FIG. 10B shows an end view of the apparatus of FIG. 2.
Figure 10A:
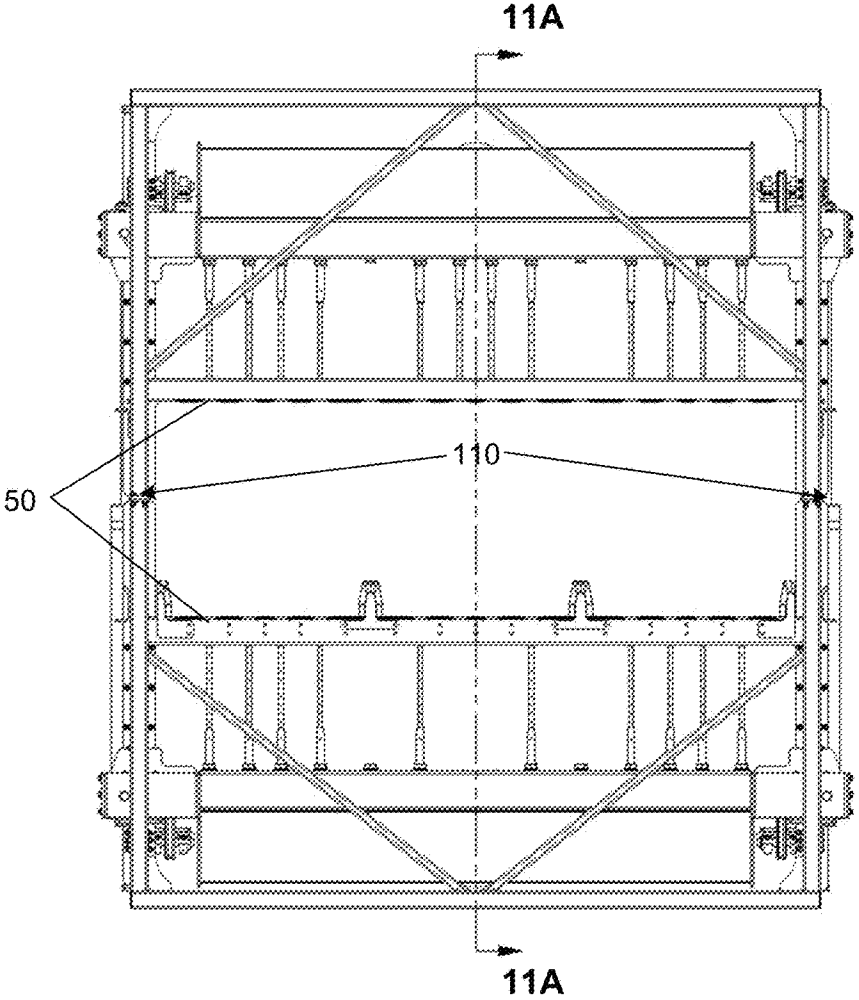
FIG. 10A shows an side view of the apparatus of FIG. 2.
Figure 11A:
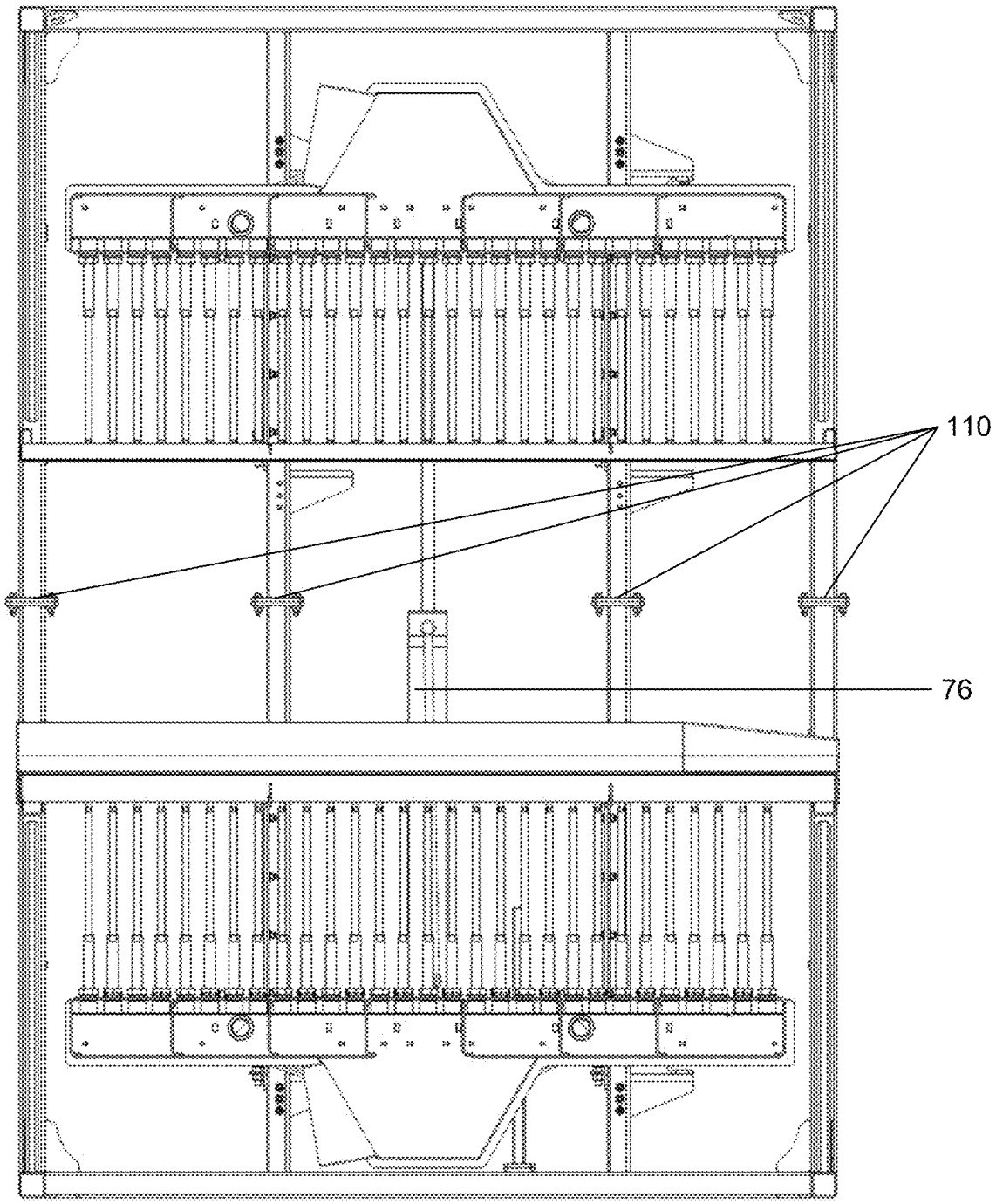
FIG. 11A shows a cross-section view of the apparatus of FIG. 2 along the line 11A-11A indicated in FIG. 10A.
Figure 11C:
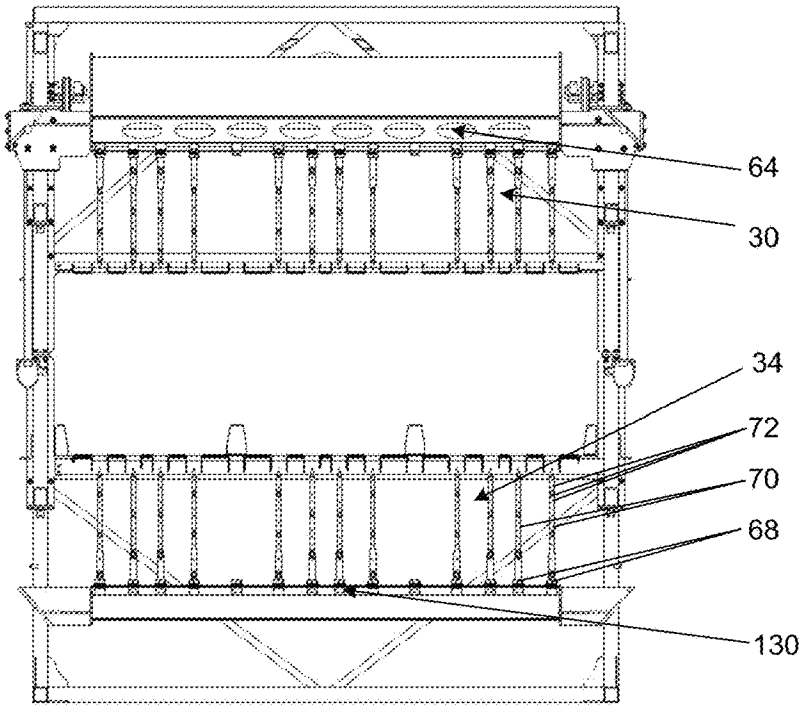
FIG. 11C shows a cross-section view of the apparatus of FIG. 2 along the line 11C-11C indicated in FIG. 10B.
Figure 11B:
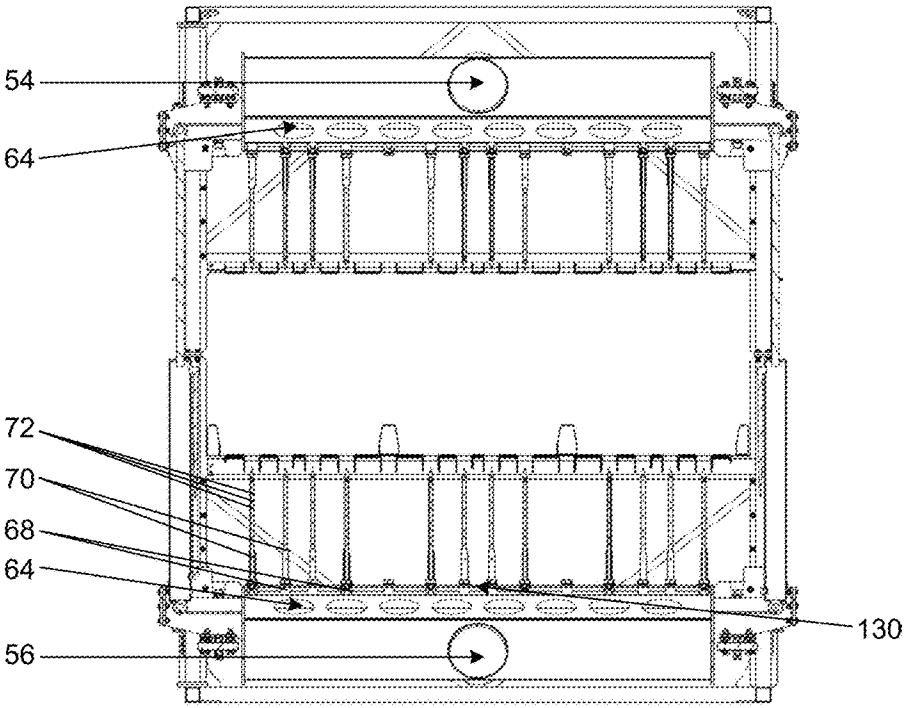
FIG. 11B shows a cross-section view of the apparatus of FIG. 2 along the line 11B-11B indicated in FIG. 10B.

For each of upper and lower air intake manifolds 24, 26, each track gear 101 is held against the corresponding track of upper and lower track sets 82, 84, by a support assembly 104, as shown particularly in FIGS. 9D-F. Support assembly 104 comprises a wheel 106 secured a fixed distance from the corresponding track gear 101. The track set 82, 84 movably coupled to a respective track gear 101 is fixedly secured to a beam or strut or support of frame 22 (e.g. vertical frame member 55) and wheel 106 rides up and down the opposite face or side or surface of the beam or strut or support from the track. The reciprocal motion of upper and lower air intake manifolds 24, 26 may be limited within a defined movement space by a combination of buffer stops 108 and structural elements of frame 22 as shown in FIG. 9A. Further, as shown in the Figures, respective track gears 101 engaging a pair of vertical frame members 55 are positioned on a same side of their respective vertical frame members 55 (e.g. a front side 109) to provide for a same direction of rotation between the track gears 101.

Upper balancing assembly 61 includes a first upper drive shaft 90, a second upper drive shaft 92, a balancing gear 98, an idler gear 107 and a synchronization chain 102. Lower balancing assembly 65 includes a first lower drive shaft 91, a second lower drive shaft 93, a balancing gear 98, an idler gear 107 and a synchronization chain 102. Upper and lower balancing assemblies 61, 65 can provide side-to-side balancing of the upper and lower air intake manifolds 24, 26 as they move between the extended and retracted positions (i.e. movement of the ends of the upper and lower air intake manifolds 24, 26 between the extended and retracted positions is substantially synchronized (e.g. at the same or similar rate)). Synchronization chain 102 can be any appropriate tightening mechanism for transferring motion of one of balancing gears 98 and/or idler gear 107 to the other gears (e.g. a belt).

First upper drive shaft 90 and a second upper drive shaft 92 (see FIG. 9C) are spaced from each other (e.g. across bale space 48) and extend between first upper end frame 49 and second upper end frame 51 through upper air chamber 28 to couple the first upper end frame 49 and second upper end frame 51. First lower drive shaft 91 and a second lower drive shaft 93 are spaced from each other (e.g. across bale space 48) and extend between first lower end frame 53 and second lower end frame 57 through lower air chamber 32 to couple first lower end frame 53 and second lower end frame 57. As shown in FIG. 9C, each of first and second upper drive shafts 90, 92 has a first end 94 and a second end 96. Each of first and second lower drive shafts 91, 93 has a first end 95 and a second end 97. For each of first and second air intake manifolds 24, 26, first and second upper drive shafts 90, 92 and first and second lower drive shafts 91, 93 are horizontal or parallel to upper and lower bale retaining members 44 and 46 and spaced from one another symmetrically about first and second hydraulic cylinders 74 and 76.

This configuration of first upper drive shaft 90 and second upper drive shaft 92 can provide the hay bale drying apparatus 20 with end-to-end balancing as the movement of first upper end frame 49 and second upper end frame 51 between the retracted and extended positions is substantially synchronized (e.g. at the same or similar rate)). Similarly, the configuration of first lower drive shaft 91 and second lower drive shaft 93 can also provide the hay bale drying apparatus 20 with end-to-end balancing as the movement of first lower end frame 53 and second lower end frame 57 between the retracted and extended positions is substantially synchronized (e.g. at the same or similar rate)). For example, actuation of actuator 52 provides vertical movement of upper and lower air intake manifolds 24, 26 between the extended and retracted positions. Vertical movement of upper and lower air intake manifolds 24, 26 causes rotation of each track gear 101 along track sets 82, 84 and rotation (e.g. synchronized rotation) of drive shafts 90, 91, 92, 93. Upper drive shafts 90, 92 and lower drive shafts 91, 93 extend from end-to-end of the upper and lower air intake manifolds 24, 26 and rotationally couple respective track gears 101 on opposite sides the upper and lower air intake manifolds 24, 26. As such, rotation of drive shafts 90, 91, 92, 93 provides for synchromonious rotation of track gears 101 positioned on opposite sides of the upper and lower air intake manifolds 24, 26. The spacing between each of upper drive shafts 90, 92 and each of lower drive shafts 91, 93 disperses the weight of the respective upper and lower air intake manifolds 24, 26 such that the upper air intake manifold 24 and the lower air intake manifold 26 remain balanced from end-to-end during vertical movement of upper and lower air intake manifolds 24, 26.

Each of upper and lower balancing assemblies 61, 65 include a pair of balancing gears 98 spaced across the upper and lower air chambers 28, 32 (e.g. across bale space 48). Balancing gears 98 are each rigidly attached to one of drive shafts 90, 91, 92, 93 near to track gear 101. Each balancing gear 98 is spaced from a respective track gear 101, as shown in FIG. 9D.

Each of upper and lower balancing assemblies 61, 65 also includes an idler gear 107 attached to a central portion of a respective end frame of end frames 49, 51, 53, 57 and a synchronization chain 102. Synchronization chain 102 extends around a pair of balancing gears 98 and idler gear 102 as shown in the Figures. Again, actuation of actuator 52 provides vertical movement of upper and lower air intake manifolds 24, 26 between the extended and retracted positions. Vertical movement of upper and lower air intake manifolds 24, 26 causes rotation of each track gear 101 along track sets 82, 84 and rotation of each respective balancing gear 98. As pairs of balancing gears 98 are spaced across each end of upper and lower air intake manifolds 24, 26 and rotationally coupled via chain 102, the upper air intake manifold 24 and the lower air intake manifold 26 remain balanced from side-to-side during vertical movement of upper and lower air intake manifolds 24, 26.

Apparatus 20 may be portable, so that it can be moved from one location to another. Apparatus 20 may be separable into two halves, one half including the upper elements and an upper portion of frame 22, and the other half including the lower elements and the lower portion of frame 22. Frame 22 may be formed of upper and lower portions joined together at one or more seam points 110, as shown particularly in FIGS. 9A and 9B. The two halves of apparatus 20 may then be placed on a truck, such as on a flatbed trailer of a transport truck. Having apparatus 20 separable into two halves may permit apparatus 20 to be easily transported where apparatus 20 may otherwise be too large to be easily transported by transport truck.

Referring again to FIG. 1, upper and lower air intake openings 54 and 56 may be fluidly connected to a blower or fan or other source of air pressure such as blower 112. Upper and lower air intake openings 54 and 56 can be connected to blower 112 by means of a hose or pipe or manifold or tube, such as tube 114. Tube 114 extends from blower 112 and branches into two passages, one passage connected to each of upper and lower air intake openings 54 and 56 to provide air pressure, which may be a flow of warmed air, to each of upper and lower air intake manifolds 24 and 26.

Blower 112 includes an engine 116, such as a 275 horse power 6.8 liter diesel engine, which engine 116 draws in ambient air to be used by or in apparatus 20. Engine 116 provides sufficient pressure to blow air through tube 114, through upper and lower air intake manifolds 24 and 26 and into hay bales placed within bale space 48 when upper and lower air intake manifolds 24 and 26 are in extended positions with upper and lower pluralities of needles 30 and 34 extended into bale space 48. Engine 116 is be configured or chosen or built or modified so as to provide an air pressure sufficient to push air through the hay bales.

The radiant heat of engine 116 is used warm the air blown into upper and lower air intake manifolds 24 and 26. For example, a heat exchanger is used to cool engine 116, and the heat exchanger includes a radiator 118 in cases of liquid cooling of engine 116. Radiator 118 is positioned between engine 116 and tube 114, and engine 116 blows air through radiator 118 to warm the air before or as the air enters into tube 114. Heating air by use of radiant heat may be preferable to use of other heating techniques, such as those which use an open flame, as other heating techniques may be particularly dangerous when used in close proximity to dry hay.

In some situations the temperature of air directed into at least one hay bale 42 in bale space 48 is raised to at least 80 degrees Fahrenheit, at least 90 degrees Fahrenheit, at least 150 degrees Fahrenheit, or higher, as these temperatures facilitate the drying of hay. The heat of the air blown into tube 114 is controlled by increasing or decreasing the flow of liquid coolant to the radiator 118, which may be an automatic process controlled by the sensed temperature of the air at various points or in various components of the system including apparatus 20. In some cases, a boiler or other heat source could also be used to raise the temperature of the air blown into at least one hay bale 42 in bale space 48.

Engine 116 can also be used to drive the actuator 52, such as when actuator 52 includes first and second hydraulic cylinders 74 and 76. The system of blower 112 and dryer 20 is generally indicated in FIG. 1 as 124.

Bales of hay for drying may be loaded into apparatus 20 in various ways. For example, hay bales may be placed on a surface, such as table 115, positioned next to apparatus 20 and at the height of lower bale retaining member 46 (see FIG. 1). The number of hay bales to be loaded into apparatus 20 at a time may depend on the size of bale space 48. Hay bales may be pushed into bale space 48 when upper and lower air intake manifolds 24 and 26 are in retracted positions. For example, a ram or piston or actuator may be placed at the far end of table 115 upon which bales are placed before drying, and this ram or piston or actuator may be used to push the hay bales off of the table 115 and into the bale space 48. Pushing hay bales into bale space 48 from one side of apparatus 20 may also serve to push hay bales resting in bale space 48 out the opposite side of apparatus 20 to be stacked or transported or used, such as when hay bales resting in bale space 48 have been dried.

Figure 13:
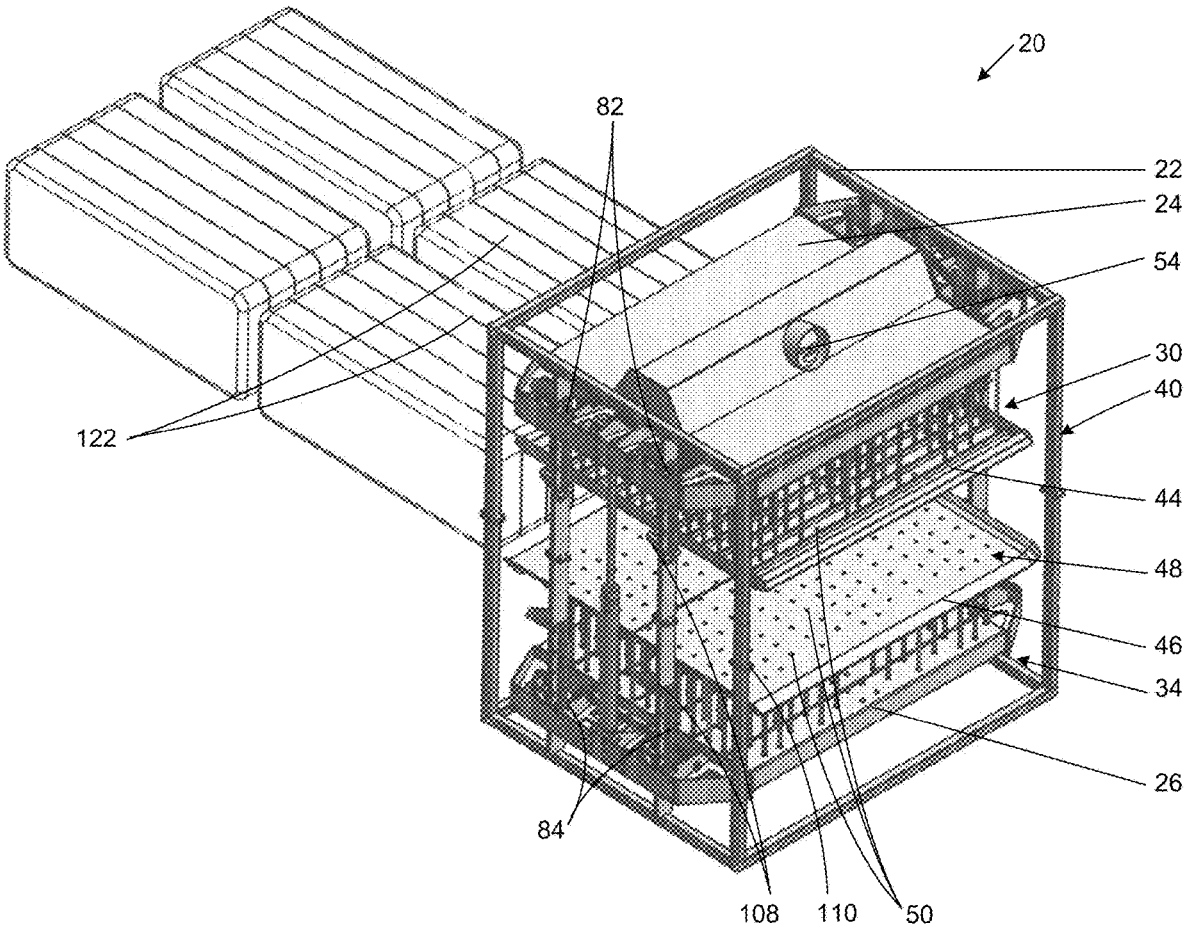
FIG. 13 shows another embodiment of the apparatus for drying hay bales of the system of FIG. 1 configured to receive two hay bales.

Apparatus 20 may be configured to dry hay bales of various sizes. For example, bale space 48 may be configured to receive either three hay bales of a first size 120, first size bales 120 being 3 feet in height by 3 feet in width by 7 feet in length (see FIGS. 2-6, 10 and 11), or two hay bales of a second size 122, second size bales 122 being 3 feet in height by 4 feet in width by 7 feet in length (see FIG. 13). Bale space 48 may have a vertical height of substantially 3 feet so as to receive bales with a height of 3 feet.

The vertical height of bale space 48 may be adjustable, such as if bale retaining members 44 and 46 are movably coupled to frame 22. However, a user may desire to maintain a fixed vertical height of bale space 48 at substantially 3 feet or 3.5 feet or 4 feet or more, to receive bales with a height of 3 feet easily and to reduce the number of moving parts.

A gap of between 2 and 10 inches may be maintained between hay bales received in the bale space. In one embodiment, a gap of approximately 6 inches may be maintained between bales. The needles 70 of upper and lower pluralities of needles 30 and 34 may be unordered in arrangement, this may be beneficial if the arrangement of at least one bale 42 within bale space 48 is not known. However, an unordered distribution of needles 70 of upper and lower pluralities of needles 30 and 34 may result in needles being between bales when upper and lower air intake manifolds 24 and 26 are in extended positions. This may result in heated air being blown by blower 112 through tube 114, through upper and lower air intake openings 54 and 56, through upper and lower air chambers 28 and 32, through the openings 50 between the air chambers and the pluralities of needles, into needles 70 of upper and lower pluralities of needles 30 and 34, out apertures 72 in the needles, and into the ambient air rather than into a bale. Alternatively, the needles 70 may instead be ordered, such as arranged in rows. Needles 70 arranged in rows may permit needles which will not be driven into at least one bale 42 when upper and lower air intake manifolds 24 and 26 are in extended positons to be removed and replaced with plugs 130 blocking needle bases 68 (see FIG. 6, for example).

The ends of needles 70 of upper plurality of needles 30 may terminate in a common upper needle plane 132, as shown in FIG. 4. The ends of needles 70 of lower plurality of needles 34 may terminate in a common lower needle plane 134, as shown in FIG. 4. Upper air chamber 28 may have a substantially horizontal lower surface to which needles 70 of upper plurality of needles 30 are secured, and needles 70 of upper plurality of needles 30 may extend approximately half a hay bale height, which may be 1.5 feet, from the lower surface of upper air chamber 28. Similarly lower air chamber 32 may have a substantially horizontal upper surface to which needles 70 of lower plurality of needles 34 are secured, and needles 70 of lower plurality of needles 34 may extend approximately half a bale height, which may be 1.5 feet, from the upper surface of lower air chamber 32. When upper and lower air intake manifolds 24 and 26 are in extended positions, the common upper and lower planes 132 and 134 may each be inserted substantially half way through the at least one bale 42 in bale space 48. Needles 70 may be maintained at a length less than half the width of a bale so that the needles of upper plurality of needles 30 will not impact the needles of lower plurality of needles 34 when the manifolds are in extended positions.

Switching between first size bales 120 and second size bales 122 may involve reconfiguring the positions of upper and lower pluralities of needles 30 and 34. For example, each needle 70 of upper and lower pluralities of needles 30 and 34 may be removably secured to needle bases 68 (see FIG. 12B). Needle bases 68 may be arranged in rows on bale-space-facing surfaces of upper and lower air chambers 28 and 32. For example, each of upper and lower air chambers 28 and 32 may include fourteen rows of needle bases 68, with one needle 70 secured to each needle base 68.

When configured to dry first sized bales 120, three sets of four rows of needles 70 may be secured to needle bases 68, with one row of needle bases 68, blocked by plugs 130, separating each of the three sets. When first sized bales 120 are received into bale space 48, actuator 52 moves upper and lower manifolds 24 and 26 into extended positions, and upper and lower pluralities of needles 30 and 34 are driven into the bales, four rows of needles 70 driven into each bale.

When configured to dry second sized bales 122, two sets of six rows of needles 70 may be secured to needle bases 68, with two rows of needle bases 68, blocked by plugs 130, separating the two sets. When second sized bales 122 are received into bale space 48, actuator 52 moves upper and lower manifolds 24 and 26 into extended positions, and upper and lower pluralities of needles 30 and 34 are driven into the bales, six rows of needles driven into each bale. This configuration is depicted as the lower needle set of FIG. 13.

Needles 70 may also be removable, not just so they can be reconfigured for use with various bale sizes, but also so that they can be replaced if they wear out or become deformed or broken. The specific shape of each needle 70 of the upper and lower pluralities of needles 30 and 34 may vary. In the embodiment shown in FIGS. 12A and 12B, the needles 70 have a long, cylindrical shape with a tapered point 136. Needles 70 are hollow to provide for air to pass through the needles 70 from and out the apertures 72 in the sides, and provided the needles 70 may be driven or pushed or pulled into at least one bale 42 in bale space 48. However, each needle 70 may be a hollow cylinder of circular cross section, and needles 70 may be of substantially uniform width or diameter along substantially the length of the needle, which width or diameter may be kept small so as not to deform bales dried by apparatus 20, as deformed bales may be of lower commercial value. The width or diameter of the needles 70 may be less than 2 inches or less than 1 inch or less than ¾ inch. The ends of the needles 70 of upper and lower pluralities of needles 30 and 34 farthest from the upper and lower air chambers 28 and 32 may terminate in tapered points 136 to more easily permit the needles to be driven or pushed or pulled into bales. Tapered points 136 may also be removable, which may permit them to be easily replaced if worn or deformed or broken.

In some embodiments, between 1 and 56 needles 70 may be used per bale from each of upper and lower air intake manifolds 24 and 26. In other embodiments, more than 56 needles 70 may be used per bale from each of upper and lower air intake manifolds 24 and 26. In other embodiments, between 5 and 36 needles may be used per bale from each of upper and lower air intake manifolds 24 and 26. A greater number of needles 70 may provide for bales of hay to be dried more uniformly. Further, a greater number of needles 70 may also provide for the needles 70 to be narrower so as to deform bales dried by the needles less than would be the case with wider needles. A greater number of needles 70 may also provide for bales to be dried more quickly and more cheaply, with substantially all warmed air being piped or pumped or applied directly into damp bales.

Baling hay with baling machines tends to produce a layered bale structure. Driving or pushing or pulling needles 70 into bales vertically may provide for air to flow more freely through typical bale structures or may permit the needles to be driven more easily into the bales. Particularly when the width of a bale may change, such as between first sized bales 120 and second sized bales 122, but the height remains the same, a user may desire to have a fixed height of bale space 48. In some situations this may result in at least one bale 42 in bale space 48 having a bale structure including layers stacked vertically. Needles driven or pushed or pulled into bales vertically may take advantage of the bale structure to more easily dry bales or more easily move needles into bales.

Various modifications to the upper and lower air chambers 28 and 32, to the tube 114, etc. may be made to direct a substantially similar volume of warmed air into each needle 70. Various modifications may be made to the needles 70 and apertures 72 to direct a substantially similar volume of warmed air through each aperture 72 of a needle 70. For example, the size of apertures 72 may be varied along the length of a needle 70. Apertures 72 may be arranged in one or more series of apertures vertically along the length of needles 70. The size of apertures 72 may decrease or increase regularly along the length of needles 70. In one embodiment, the diameter of apertures 72 is largest for the apertures 72 near the air chambers 28, 32 to which the needles 70 are connected and decreases along the series towards tapered point 136.

A drying cycle may include the steps of moving at least one bale 42 into bale space 48, moving upper and lower air intake manifolds 24 and 26 into extended positions, turning on blower 112, turning off blower 112, moving upper and lower air intake manifolds 24 and 26 into retracted positions, and removing at least one bale 42 from bale space 48. When upper and lower air intake manifolds 24 and 26 are in extended positions, blower 112 may blow air across radiator 118, into tube 114, through air intake openings 54 and 56 of upper and lower manifolds 24 and 26, respectively, into upper and lower air chambers 28 and 32, through openings 50, into needles 70 of upper and lower pluralities of needles 30 and 34, through apertures 72, and into at least one bale 42 placed within bale space 42.

The period of time between turning blower 112 on and turning blower 112 off may be automatically determined by sensing the moisture content of at least one bale 42. For example, a scale may be placed under apparatus 20 to determine the weight of at least one bale 42, and may permit blower 112 to be turned off automatically when the weight of at least one bale 42 reaches a desired weight.

When hay is first cut, the moisture content may be 50 percent, it may be 60 percent, it may be 70 percent, it may be 80 percent, or it may be more. In some situations hay may be left to dry in the field until the moisture content reaches a desired level, such as between 5 and 20 percent, and then baled. In other situations, hay may be left in a field to dry for a period of time to reduce the moisture content somewhat before being baled. Baled hay may have a moisture content of 25 percent, or 30 percent or 35 percent or more. In some situations, a user may desire to dry at least one bale 42 to a moisture content of between 5 and 20 percent, or between 10 and 15 percent, or approximately 10 percent.

In some situations a user may desire to bale hay without leaving it in the field for a significant period of time, as the sun may bleach hay and cause the protein-rich leaves to dry and crumble or break or be removed or fall to the ground before the hay can be baled. In some situations a user may desire to bale the hay while still damp so as to ensure that the protein-rich leaves remain in the hay. In some situations damp hay may pose a mold risk or rot risk or fire risk or lower value risk, which may be lessened by drying the hay to a desired moisture content.

In one embodiment, a period of time between when blower 112 turns on and when blower 112 turns off may be determined automatically by sensing when at least one bale 42 has a desired moisture content.

While apparatus 20 is depicted and described as symmetrical, with upper and lower portions mirroring one another, in other embodiments it may be convenient to limit apparatus 20 to one set of manifold and bale retaining member, or to make other modifications to the above description.

All elements or features or components of apparatus 20 and the associated hoses, tubes, engines, blowers, etc. may be removable such that they may be replaced or repaired unless expressly described otherwise.

While apparatus 20 has been described primarily with relation to its use in drying hay bales, hay bales are only used as a convenient example. Apparatus 20 may also be used to dry bales of straw or other similar materials, such as other similar fodder materials. Apparatus 20 may be modified for use with different materials as well. For example, when used to dry relatively loose bales of fodder, such as straw bales, apparatus may employ a small number of larger needles, however when used to dry bales of denser fodder, such as hay bales, a greater number of narrower needles 70 may permit apparatus 20 to more easily be used to dry dense material.

While the above description provides examples of one or more apparatus, methods, or systems, it will be appreciated that other apparatus, methods, or systems may be within the scope of the claims as interpreted by one of skill in the art.

The invention claimed is:

1. An apparatus for drying hay bales, comprising:

a support frame;

an upper air intake manifold movably coupled to the support frame for supplying heated air, the upper air intake manifold comprising an upper air chamber and a plurality of hollow needles extending downwardly therefrom, the needles having a series of apertures therein, the apertures allowing the heated air to exit;

a lower intake manifold movably couple to the support frame for supplying heated air, the lower air intake manifold comprising an air chamber and a plurality of hollow needles extending upwardly therefrom, the needles having a series of spaced apertures therein, the apertures allowing the heated air to exit;

a bale retainer coupled to the support frame between the upper air chamber and the lower air chamber, the bale retainer being configured for retaining at least one hay bale in a fixed vertical position between the upper air chamber and the lower air chamber, the bale retainer member and a horizontally extending lower bale retaining member spaced from the upper bale retaining member a vertical distance defining a bale spaced sized to receive the at least one hay bale, the bale retaining members having openings that allow the plurality of needles to enter the bale space; and an actuator coupled to the upper air intake manifold and the lower air intake manifold, the actuator being configured for moving the upper air intake manifold and the lower air intake manifold between a retracted position in which the needles are retracted outside the bale space and an extended position in which the needles extend through the openings into the bale space.

2. The apparatus of claim 1, wherein the hollow needles of the upper intake manifold terminated in a common first needle plane a first needle length from the upper air intake manifold and the hollow needles of the lower air intake manifold terminate in a common second needle plate a second needle length from the lower air intake manifold.

3. The apparatus of claim 2, wherein the hollow needles of the upper air intake manifold and the hollow needles of the lower air intake manifold terminate in tapered points.

4. The apparatus of claim 3, wherein the series of apertures in each needle of the hollow needles of the upper air intake manifold and the hollow needles of the lower air intake manifold is aligned along the length of each needle, the apertures in each series of apertures decreasing in size from the aperture nearest the air chamber to the aperture farthest from the air chamber.

5. The apparatus of claim 1, wherein the actuator comprises a pair of parallel vertical linear actuators each coupled to the upper air intake manifold and the lower air intake manifold and spaced on opposite sides of the bale space.

6. The apparatus of claim 5, wherein the linear actuators are hydraulic cylinders.

7. The apparatus of claim 1, wherein the upper air intake manifold comprises an upper manifold coupling assembly for moveably coupling the upper air chamber to the support frame, the lower air intake manifold comprises a lower manifold coupling assembly for movably coupling the lower air chamber to the support frame, and the actuator extends between the upper manifold coupling assembly and the lower manifold coupling assembly.

8. The apparatus of claim 7, wherein the support frame comprises a pair of vertical support frame members on each end of the support frame, the upper manifold coupling assembly comprises a pair of upper end frames extending outwards from end walls of the upper air chamber and the lower manifold coupling assembly comprises a pair of lower end frames extending outwards from end walls of the lower air chamber, each upper and lower end frame being configured to be movably coupled to the vertical support frame members, each pair of vertical support frame members being spaced from one another.

9. The apparatus of claim 8, wherein each of the vertical support frame members comprises an upper vertical track set and a lower vertical track set and each of the upper and lower coupling assemblies comprises a pair of track gears rigidly attached to the each upper and lower end frame, each track gear configured and positioned to mesh with a respective vertical track set of the vertical support frame members to movably couple each upper and lower end frame to the vertical support frame members.

10. The apparatus of claim 9, wherein the upper coupling assembly further comprises a pair of upper drive shafts extending from one upper end frame through the upper air chamber to the upper end frame, the lower coupling assembly further comprises a pair of lower drive shafts extending from one lower end frame through the lower air chamber to the other lower end frame, the upper drive shafts being spaced from one another and the lower drive shafts being spaced from one another to provide that the upper and lower manifold coupling assemblies are balanced from end-to-end during movement between the retracted position and the extended position.

11. The apparatus of claim 10, wherein the upper coupling assembly further comprises a pair of upper balancing gears rigidly attached to a respective upper drive shaft near an end of a respective track gear, an upper idler gear attached to a central portion of each upper end frame, and an upper synchronization chain extending around the upper balancing gears and the upper idler gear of each upper end frame, and the lower coupling assembly further comprises a pair of lower balancing gears rigidly attached to a respective upper drive shaft near an end of a respective track gear, a lower idler gear attached to a central portion of each lower end frame and a lower synchronization chain extending around the lower balancing gears and the lower idler gear of each lower end frame.

12. The apparatus of claim 1, wherein the upper and lower bale retaining members are plates having a plurality of apertures through which the needles of the upper and lower pluralities of needles may pass.

13. The apparatus of claim 1, wherein the upper and lower bale retaining members are racks formed of parallel and perpendicular beams with gaps between the beams through which the needles of the upper and lower pluralities of needles may pass.

14. The system of claim 13, wherein the engine is further configured to drive the actuator.

15. A system for drying hay bales, comprising;

the hay bale dryer of claim 1;

a blower, the blower including an engine configured to move a volume of air and a radiator configured to disperse the heat of the engine; and a tube fluidly connected to the blower and to the hay bale dryer and configured to carry the volume of air from the blower and split the volume of air between the upper and lower air intake manifolds, wherein the radiator is positioned between the engine and the tube and configured to disperse the heat of the engine into the volume of air as the engine moves the volume of air into the tube.

* * * * *